US010238263B2

(12) United States Patent
Huang

(10) Patent No.: US 10,238,263 B2
(45) Date of Patent: Mar. 26, 2019

(54) CLEANING TOOL

(71) Applicant: Zhiyong Huang, Cixi (CN)

(72) Inventor: Zhiyong Huang, Cixi (CN)

( * ) Notice: Subject to any disclaimer, the term of this patent is extended or adjusted under 35 U.S.C. 154(b) by 237 days.

(21) Appl. No.: 15/120,296

(22) PCT Filed: Jan. 23, 2015

(86) PCT No.: PCT/CN2015/071381
§ 371 (c)(1),
(2) Date: Aug. 19, 2016

(87) PCT Pub. No.: WO2015/169114
PCT Pub. Date: Nov. 12, 2015

(65) Prior Publication Data

US 2017/0065144 A1 Mar. 9, 2017

(30) Foreign Application Priority Data

May 5, 2014 (CN) ..... 2014 1 0185680

(51) Int. Cl.
*A47L 13/50* (2006.01)
*A47L 13/58* (2006.01)
*A47L 13/20* (2006.01)

(52) U.S. Cl.
CPC ..... *A47L 13/58* (2013.01); *A47L 13/20* (2013.01)

(58) Field of Classification Search
CPC ..... A47L 13/50; A47L 13/58
USPC ..... 15/257.01, 260, 263, 264; 34/58
See application file for complete search history.

(56) References Cited

U.S. PATENT DOCUMENTS 5,771,719 A * 6/1998 Moon ..... D06F 17/06 68/183
2012/0167321 A1* 7/2012 Lee ..... A47L 13/258 15/119.2
2015/0128373 A1* 5/2015 Lin ..... A47L 13/58 15/260

OTHER PUBLICATIONS

STIC search, see attached.*

* cited by examiner

*Primary Examiner* — Monica S Carter
*Assistant Examiner* — Abbie E Quann
(74) *Attorney, Agent, or Firm* — Wang Law Firm, Inc.

(57) ABSTRACT

A cleaning tool set includes a rod; a mop head attached to the rod; a wiper attached to the mop head; and a bucket for receiving the mop; the rod includes an inner rod, an outer rod sleeved at least partially over the inner rod, and a driving mechanism for converting a telescopic motion between the inner rod and an outer rod into a rotating motion of the rod; the bucket includes at least one container, a rotatable dewatering frame with a central shaft. While the mop head is rotating with the rod to be dewatered, the mop head is put in the dewatering frame, and the water pumping device is driven by the drive mechanism to drain water out of the container which has the dewatering frame disposed therein.

18 Claims, 13 Drawing Sheets

CLEANING TOOL

RELATE APPLICATIONS

This application is a national phase entrance of and claims benefit to PCT Application for a cleaning tool, PCT/CN2015/071381, filed on Jan. 23, 2015, which claims benefit to Chinese Patent Applications 201410185680.9, filed on May 5, 2014. The specifications of both applications are incorporated here by this reference.

FIELD OF THE INVENTION

The present invention relates to a cleaning tool set.

DESCRIPTION OF THE PRIOR ART

Generally, a hand-pressed round spin mop (i.e., with a round mop head) includes a bucket and a rod, with a mop head which may have a wiper being provided at a lower end of the rod; the rod includes an inner rod and an outer rod at least partially over the inner rod, and a driving mechanism is disposed inside the outer rod and between the inner rod and the outer rod for converting a telescopic motion between the inner rod and an outer rod into a rotating motion of the rod; and a rotatable dewatering frame with a central shaft is provided within the bucket. During dewatering, the mop head is put in the dewatering frame, and the mop head is rotated for dewatering.

Although the hand-pressed round spin mop is used relatively conveniently, it is still less convenient than a flat mop (i.e., a mop with a flat mop head). Especially in cleaning corners and mopping along the wall, the round mop is more inconvenient. There are flat mop products in the prior art, for example, those provided in Chinese Invention Patent ZL201320275150.4 and the like.

However, at present, round mops are dominant in the market. This is mainly because a flat mop needs to be folded during dewatering, and since the folded flat mop head generates a certain height, if it is required to spin-dry the flat mop, the dewatering basket needs to be manufactured higher to receive the folded flat mop head, and meanwhile the height of the bucket body also needs to be increased accordingly to reserve a certain space below the dewatering basket for receiving the spun water while receiving the dewatering basket. Consequently, a longer flat mop head is manufactured at the expense of increasing the height of the bucket body. As a result, the bucket will become very huge and it will be very inconvenient for use. Thus, for the flat mops in the market, in order to reduce the container of the bucket body thereof, the length of the flat mop is sacrificed.

SUMMARY OF THE INVENTION

A technical problem to be solved by the present invention is, in view of the prior art, to provide a cleaning tool set on which a longer flat mop head can be used and which has a smaller bucket size.

To solve the above technical problem, a first solution is that, the cleaning tool set comprises a rod; a mop head attached to the rod; a wiper attached to the mop head, the rod, the mop head, and the wiper forming a mop; and a bucket for receiving the mop;

the rod comprises an inner rod, an outer rod sleeved at least partially over the inner rod, and a driving mechanism disposed inside the outer rod and between the inner rod and the outer rod for converting a telescopic motion between the inner rod and an outer rod into a rotating motion of the rod;

the bucket comprises at least one container, a rotatable dewatering frame with a central shaft disposed inside the at least one container, and a water pumping device connected to the dewatering frame or the central shaft, the water pumping device has a water inlet; the water inlet of the water pumping device is located below the dewatering frame; when the mop head engages the dewatering frame, the drive mechanism drives the water pumping device and drains water out of the at least one container.

For the structure of the water pumping device and the specific driving mode and structure of the drive mechanism, a first preferable embodiment is that, the drive mechanism drives the dewatering frame to rotate, and the dewatering frame has a bottom surface and a driving gear disposed on the bottom surface;

the water pumping device is an impeller pump, which includes a pump body, an impeller, a pump shaft disposed in a center of the impeller; the pump body is located within the at least one container with the dewatering frame disposed therein, the pump body has a pump chamber in communication with the outside; the impeller is disposed inside the pump chamber; the pump shaft has a top extending out of a top of the pump body, and the pump shaft has a driven gear on the top of the pump shaft, the driven gear is engaged with the driving gear.

For the structure of the water pumping device and the specific driving mode and structure of the drive mechanism, a second preferable embodiment is that, the drive mechanism drives the central shaft to rotate, and a gear sleeve disposed on the central shaft and the gear sleeve has a driving gear;

the water pumping device is an impeller pump, which includes a pump body, an impeller, a pump shaft disposed in a center of the impeller; the pump body is located within the at least one container with the dewatering frame disposed therein, the pump body has a pump chamber communication with outside; the impeller is disposed inside the pump chamber; the pump shaft has a top extending out of a top of the pump body, and the pump shaft has a driven gear on the top of the pump shaft, the driven gear is engaged with the driving gear.

For the structure of the water pumping device and the specific driving mode and structure of the drive mechanism, a third preferable embodiment is that, the central shaft has a cap disposed on the head of central shaft, the drive mechanism drives the cap to rotate, and a gear sleeve disposed on the central shaft and under the cap and the gear sleeve has a driving gear;

the water pumping device is an impeller pump, which includes a pump body, an impeller, a pump shaft disposed in a center of the impeller; the pump body is located within the at least one container with the dewatering frame disposed therein, the pump body has a pump chamber communication with outside; the impeller is disposed inside the pump chamber; the pump shaft has a top extending out of a top of the pump body, and the pump shaft has a driven gear on the top of pump shaft, the driven gear is engaged with the driving gear.

For the structure of the water pumping device and the specific driving mode and structure of the drive mechanism, a fourth preferable embodiment is that, the drive mechanism drives the dewatering frame to rotate, the water pumping device is a screw pump, which includes a pumping column and a rotatable screw disposed out of the central shaft and inside the pumping column, the pumping column has a bottom and the bottom of the pumping column is connected with the bucket, the dewatering frame has a bottom surface and the top of the screw is connected with the bottom surface of the dewatering frame, so that the screw can rotate together with the dewatering frame and pump the water inside the pumping column upwards;

the pumping column has a plurality of water pumping holes located below the dewatering frame.

For the structure of the water pumping device and the specific driving mode and structure of the drive mechanism, a fifth preferable embodiment is that, the drive mechanism drives the central shaft to rotate, the water pumping device is a screw pump, which includes a pumping column and a screw disposed on the central shaft rotatably with the central shaft and inside the pumping column, the pumping column has a bottom and the bottom of the pumping column is connected with the bucket, so that the screw can rotate together with the central shaft and pump the water inside the pumping column upwards;

the pumping column has a plurality of water pumping holes located below the dewatering frame.

For the structure of the water pumping device and the specific driving mode and structure of the drive mechanism, a sixth preferable embodiment is that, the central shaft has a cap disposed on the head of the central shaft, the drive mechanism drives the cap to rotate;

the water pumping device is a screw pump, which includes a pumping column and a screw disposed out of the central shaft rotatably with the cap and inside the pumping column, the pumping column has a bottom an the bottom of the pumping column is connected with the bucket, so that the screw can rotate together with the cap and pump the water inside the pumping column upwards;

the pumping column has a plurality of water pumping holes located below the dewatering frame.

Preferably, the cleaning tool set further comprises a cleaning bucket having a cleaning basket disposed in the cleaning bucket, a cleaning spindle is provided in the center of the cleaning basket, and the cleaning basket is mounted inside the cleaning bucket through the cleaning spindle.

Preferably, the cleaning tool set further comprises a cleaning and dewatering bucket, which also has the dewatering frame and the water pumping device disposed in;

the water pumping device of the bucket can drain water to the cleaning and dewatering bucket, and the water pumping device in the cleaning and dewatering bucket can drain water to the container with the dewatering frame.

To solve the above technical problem, a second solution is that, the cleaning tool set comprises a rod; a mop head attached to the rod; a wiper attached to the mop head, the rod, the mop head, and the wiper forming a mop; and a bucket for receiving the mop;

wherein, the rod comprises an inner rod, an outer rod sleeved at least partially over the inner rod, and a driving mechanism disposed inside the outer rod and between the inner rod and the outer rod for converting a telescopic motion between the inner rod and an outer rod into a rotating motion of the rod;

the bucket comprises at least one container, a rotatable dewatering frame with a central shaft disposed inside at least one container, and a water pump having a water inlet is disposed inside the at least one container having the rotatable dewatering frame, the water inlet of the water pump is located below the dewatering frame, a switch for operating the water pump is disposed inside the at least one container having the dewatering frame; and the water pump drains water in the at least one container having the dewatering frame.

Specifically, the switch is a water level switch located below the dewatering frame, and the water level switch is located within the container having the dewatering frame disposed therein. Or, the switch is a float switch located below the dewatering frame, and the float switch is located within the container having the dewatering frame disposed therein.

Preferably, the cleaning tool set further comprises a cleaning bucket having a cleaning basket having a cleaning basket disposed therein, a cleaning spindle is disposed in the center of the cleaning basket, and the cleaning basket is disposed inside the cleaning bucket through the cleaning spindle.

Preferably, the cleaning tool set further comprises a cleaning and dewatering bucket, which also has the dewatering frame, the water pump and the switch disposed therein;

the water pump in the bucket can drain water to the cleaning and dewatering bucket, and the water pump in the cleaning and dewatering bucket can drain water to the container having the dewatering frame.

To solve the above technical problem, a third kind of solution is that, the cleaning tool set has no dewatering frame, and during dewatering, the mop head is directly rotating on/with a rotating shaft for dewatering. Specifically, there are following three solutions.

1. The water pumping device is driven by the mop head to pump water. The cleaning tool set comprises a rod; a mop head attached to the rod; a wiper attached to the mop head, the rod, the mop head, and the wiper forming a mop; and a bucket for receiving the mop;

wherein, the rod comprises an inner rod, an outer rod sleeved at least partially over the inner rod, and a driving mechanism disposed inside the outer rod and between the inner rod and the outer rod for converting a telescopic motion between the inner rod and an outer rod into a rotating motion of the rod;

the bucket comprises at least one container and a water pumping device having a water inlet, a rotating shaft with a rotating plate is disposed inside the at least one container, and the rotating plate has a plurality of retaining ribs for the mop head to resist against;

when the mop head engages the rotating shaft, the mop head rotates the rotating plate, and the water pumping device is driven by the rotating plate to drain water out of at least one container which has the rotating shaft disposed therein; the water inlet of the water pumping device is located below the mop head when the mop head is located on the rotating shaft.

2. The water pumping device is driven by a cap. The cleaning tool set comprises a rod; a mop head attached to the rod; a wiper attached to the mop head, the rod, the mop head, and the wiper forming a mop; and a bucket for receiving the mop;

wherein, the rod comprises an inner rod, an outer rod sleeved at least partially over the inner rod, and a driving mechanism disposed inside the outer rod and between the inner rod and the outer rod for converting a telescopic motion between the inner rod and an outer rod into a rotating motion of the rod;

the bucket comprises at least one container and a water pumping device having a water inlet, a rotating shaft with a cap disposed on a head of the rotating shaft is disposed inside the at least one container;

when the mop head engages the cap, the drive mechanism drives the cap to rotate; and the water pumping device is driven by the cap to drain water out of the at least one container with the rotating shaft; the water inlet of the water pumping device is located below the mop head when the mop head engages the cap.

3. The water pumping device is driven by a rotating shaft. The cleaning tool set comprises a rod; a mop head attached to the rod; a wiper attached to the mop head, the rod, the mop head, and the wiper forming a mop; and a bucket for receiving the mop;

wherein, the rod comprises an inner rod, an outer rod sleeved at least partially over the inner rod, and a driving mechanism disposed inside the outer rod and between the inner rod and the outer rod for converting a telescopic motion between the inner rod and an outer rod into a rotating motion of the rod;

the bucket comprises at least one container and a water pumping device having a water inlet, a rotating shaft is disposed inside the at least one container;

when the mop head engages the rotating shaft, the drive mechanism drives the rotating shaft to rotate; and the water pumping device is driven by the rotating shaft to drain water out of the at least one container with the rotating shaft; the water inlet of the water pumping device is located below the mop head when the mop head engages the rotating shaft.

Under the situation that the cleaning tool set has no cleaning bucket and the cleaning and dewatering bucket: the mop head of the mop is disposed inside the dewatering frame, and in this way, either cleaning or dewatering can be performed. During dewatering, there is no water within the at least one container with the dewatering frame disposed therein, and the mop head of the mop is disposed within the dewatering frame. As in the prior art, the rod is pressed so that the dewatering frame and the mop head are rotated for spin-drying. The spun water is maintained within the at least one container with the dewatering frame disposed therein, the water pumping device is driven by the drive mechanism, and water within the at least one container with the dewatering frame disposed therein is pumped out by the water pumping device. Thus, the height of the bucket body can be reduced, and different from the bucket body in the prior art, it is unnecessary to provide a water storage space below the dewatering frame.

During cleaning, water is injected into the at least one container with the dewatering frame disposed therein, the mop head of the mop is directly put in the dewatering frame, and the mop head is immersed into water. As in the prior art, the rod is pressed, and the mop head and the dewatering frame are rotated so that cleaning can be realized. Meanwhile, during cleaning, the water pumping device is driven by the drive mechanism, and water within the at least one container with the dewatering frame disposed therein is pumped out by the water pumping device, so that the dewatering after cleaning can be realized.

Under the situation that the cleaning tool set has the bucket and the cleaning bucket: as described above, both dewatering and cleaning can be performed within the at least one container with the dewatering frame disposed therein, and the water pumping device can pump water within the at least one container with the dewatering frame disposed therein to the cleaning bucket. Cleaning can be performed within the cleaning bucket. The mop head of the mop is directly put in the cleaning basket and then immersed into water. As in the prior art, the rod is pressed to drive the cleaning basket and the mop head to rotate so that the cleaning can be realized. Water within the cleaning bucket can be transferred from the bucket, and thus water saving is realized.

Under the situation that the cleaning tool set has the bucket and the cleaning and dewatering bucket: it is equivalent to provide two same containers having the dewatering frame mounted therein. Both dewatering and cleaning can be performed in either the at least one container with the dewatering frame disposed therein or the cleaning and dewatering bucket. Water within the cleaning bucket can be transferred to the cleaning and dewatering bucket, and water within the cleaning and dewatering bucket can be transferred to the at least one container with the dewatering frame disposed therein.

Another working principle of the present invention is similar to the foregoing working principle, except that the water pumping is realized by a water pump and the operation of the water pump is controlled by a switch.

Under the situation that the cleaning tool set has no the dewatering frame, the mop head can also be rotated for dewatering, with the exception that there is no constraint from the dewatering frame.

Compared with the prior art, the present invention has the following advantages: different from the bucket body in the prior art, it is not required to provide a water storage space below the dewatering frame, so the height of the bucket body can be reduced, and the mop head of the flat mop can be lengthened correspondingly so that it is more suitable for the flat mop to match therewith.

DETAILED DESCRIPTION OF THE PREFERRED EMBODIMENT

Figure 1:
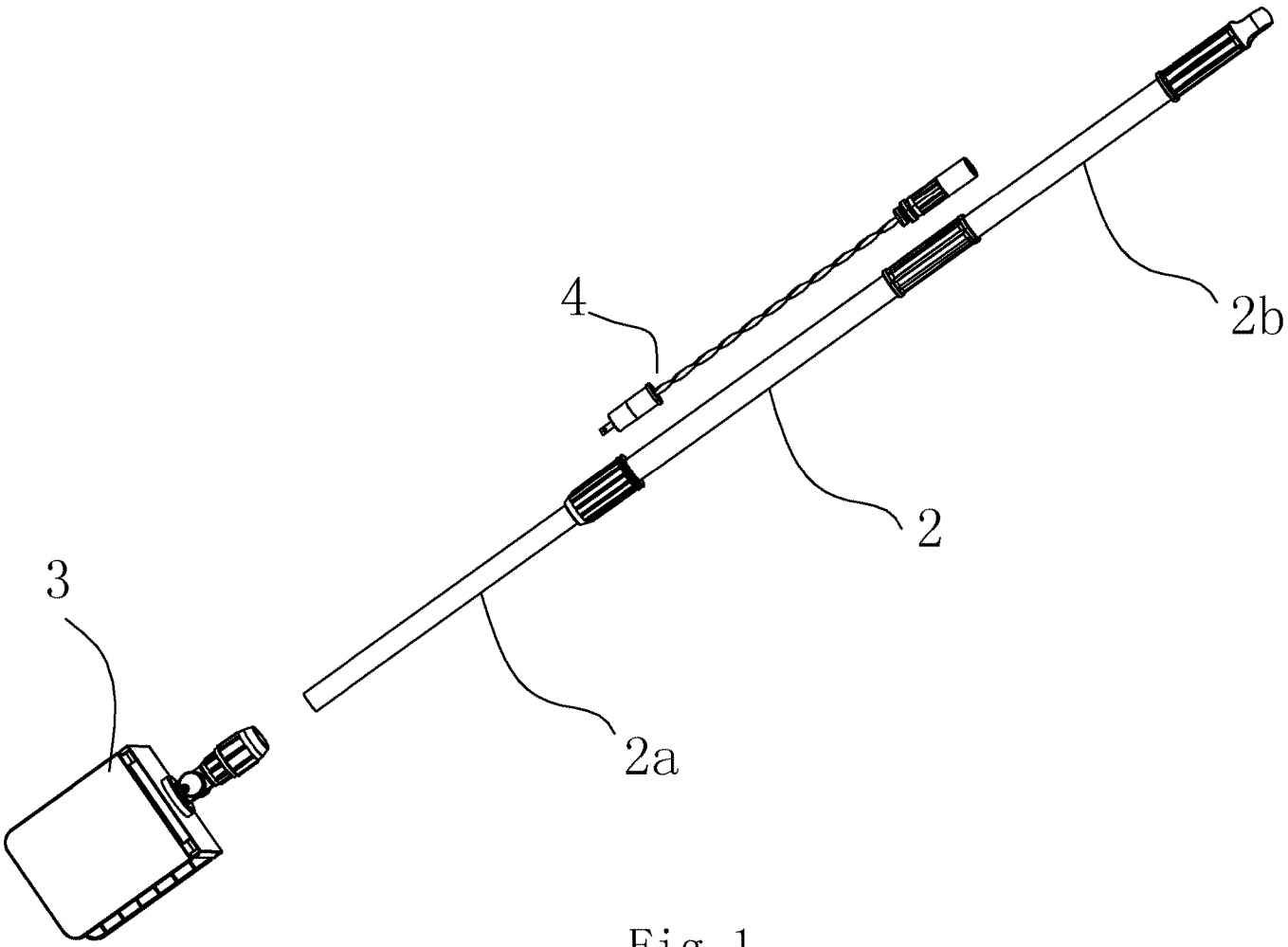
FIG. 1 is a perspective view of a mop according to Embodiment 1-16 of the present invention.
Figure 3:
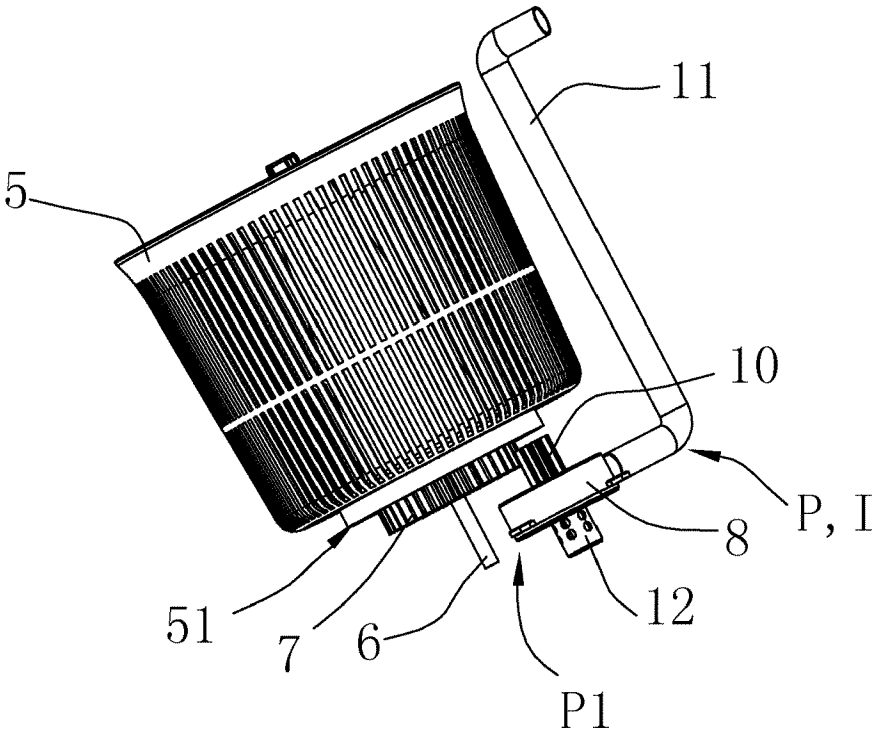
FIG. 3 is a perspective view of a water pumping device driven by a dewatering frame according to Embodiment 1 of the present invention.
Figure 2:
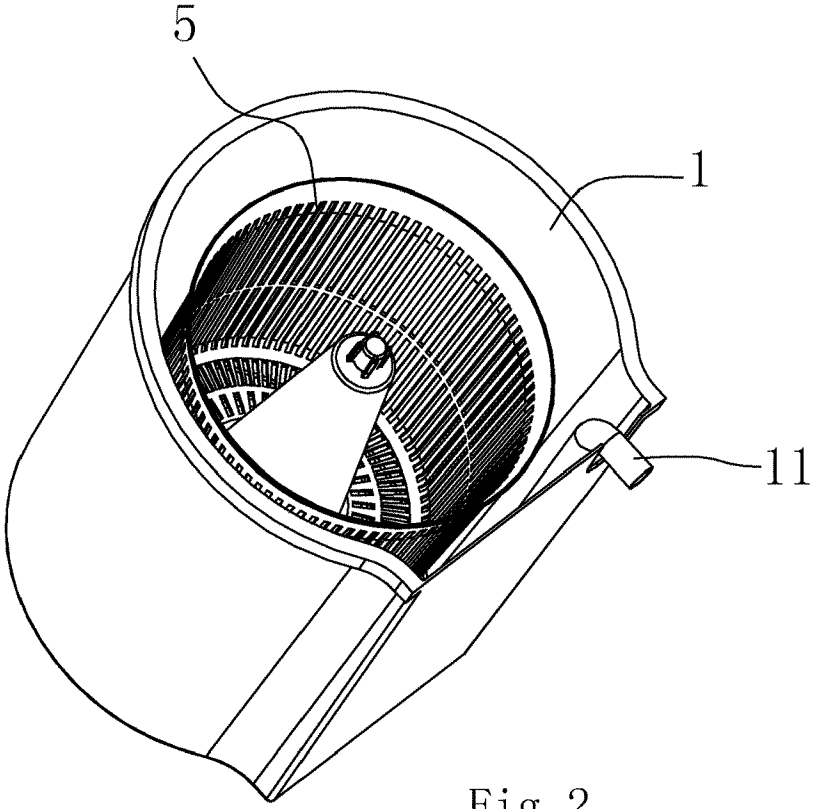
FIG. 2 is a perspective view of a bucket according to Embodiment 1 of the present invention.

To enable a further understanding of the present invention content of the invention herein, refer to the detailed description of the invention and the accompanying drawings below:

Embodiment 1

FIG. 1-FIG. 7 show a first embodiment of the cleaning tool set. The cleaning tool set comprises a rod 2; a mop head 3 attached to the rod 2; a wiper attached to the mop head 3, the rod 2, the mop head 3, and the wiper forming a mop; and a bucket 1 for receiving the mop.

The rod 2 comprises an inner rod 2*a*, an outer rod 2*b* sleeved at least partially over the inner rod 2*a*. The mop head 3 is connected at the lower end of the inner rod 2*a*, and a drive mechanism 4 is disposed between the inner rod 2*a* and the outer rod 2*b* for converting a telescopic motion between the inner rod 2*a* and an outer rod 2*b* into a rotating motion of the rod 2 (if the inner rod 2*a* is on the top while the outer rod 2*b* is on the bottom, the mop head 3 is connected at the lower end of the outer rod 2*b* and the telescopic motion of the rod 2 is converted into the rotating motion of the inner rod 2*a*; however, in practices, it is basically impossible to employ a structure in which the inner rod 2*a* is on the top while the outer rod 2*b* is on the bottom). The specific structure form of the drive mechanism 4 belongs to the conventional means in the art and will not be repeated here.

The bucket 1 comprises at least one container 13, a rotatable dewatering frame 5 with a central shaft 6 disposed inside the at least one container 13. In this embodiment, the bucket 1 has only one container 13, and the bucket 1 itself is the container 13.

The bucket 1 is further provided with a water pumping device P. A water inlet of the water pumping device P is located below the dewatering frame 5. During the mop head 3 is rotating with the rod 2 to be dewatered, the mop head 3 is put in the dewatering frame 5, and the water pumping device P is driven by the drive mechanism 4 to drain water out of the container 13 which has the dewatering frame 5 disposed therein In this embodiment, the structure of the water pumping device P and the specific driving mode and structure of the drive mechanism 4 are as below.

The drive mechanism 4 drives the dewatering frame 5 to rotate, and the dewatering frame 5 then drives the water pumping device P to operate. A driving gear 7 is disposed on the bottom surface of the dewatering frame 5. The water pumping device P is an impeller pump I, which includes a pump body 8. The pump body 8 has a pump chamber C in communication with outside and an impeller 9 is disposed inside the pump chamber C. A pump shaft is disposed in a center of the impeller 9. The pump shaft has a top extending out of a top of the pump body 8, and the pump shaft has a driven gear 10 on the top of the pump shaft, the driven gear 10 is engaged with the driving gear 7. The rotation of the dewatering frame 5 drives the driving gear 7 to rotate so as to drive the pump shaft and the impeller 9 to rotate through the driven gear 10, so that water pumping is realized and water can be drained through a water pumping pipe 11. The rotation of the dewatering frame 5 is driven by the drive mechanism 4. The way of driving the dewatering frame 5 by the drive mechanism 4 belongs to the conventional means in the art and this function can be realized by existing cleaning tools, and thus will not be repeated here.

Figure 7:
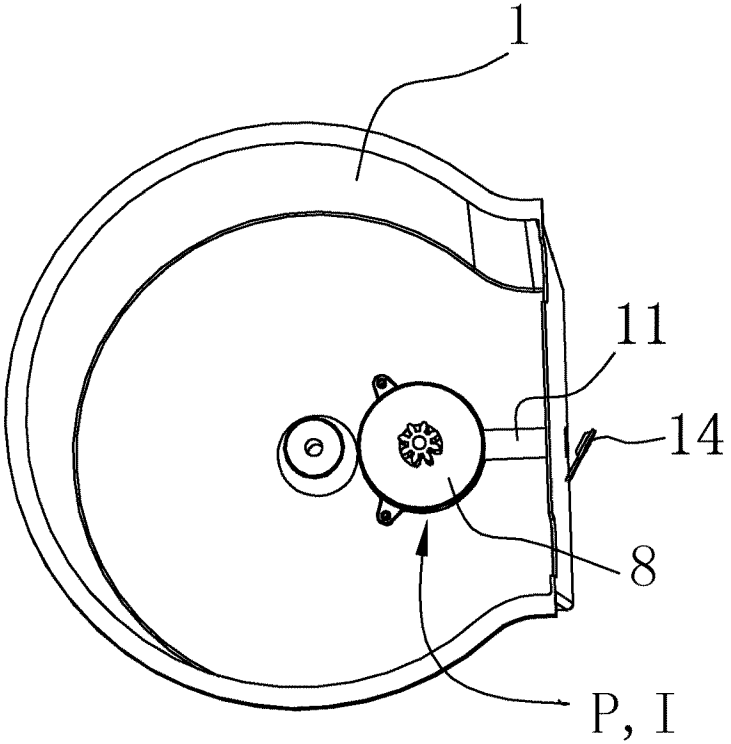
FIG. 7 is a perspective view of another structure of water outlet of the present invention.

To pump water out completely, the water pumping device P is located on the bottom of the bucket 1. In other words, the pump body 8 is located on the bottom of the bucket 1. The bottom of the pump body 8 can be extended downward to form a downward extension drum 12, and an opening is formed on the downward extension drum 12, so that water is pumped out through the opening. Water is pumped out more completely after the downward extension drum 12 is provided. The water pumping pipe 11 can be extended from the upper end of the bucket 1, or can be directly extended from the bottom of the bucket 1, as shown in FIG. 7. A row of water outlets can be provided on the bottom of a side wall of the bucket 1. Plugs 14 are provided within the water outlets. The water outlets are plugged by the plugs 14 when water pumping is not required.

In this embodiment, an impeller pump is used. Of course, it is also possible to use a gear pump, a displacement pump or the like. When a gear pump, a displacement pump or the like is used, as described in this embodiment, it is also possible to rotate the dewatering frame 5 so as to transfer power into the pump through the drive mechanism 4. The form of the drive mechanism 4 can be a gear drive mechanism as described in this embodiment, or can be other power transmission mechanisms. The designs of such a drive mechanism can be easily realized by those skilled in the art, and will not be enumerated.

In this embodiment, an impeller pump I is used, and thus, the water pumping device is located within the bucket body. Of course, a self-priming pump or the like can also be used. In this case, the water pumping device can be mounted outside the bucket body.

Figure 6:
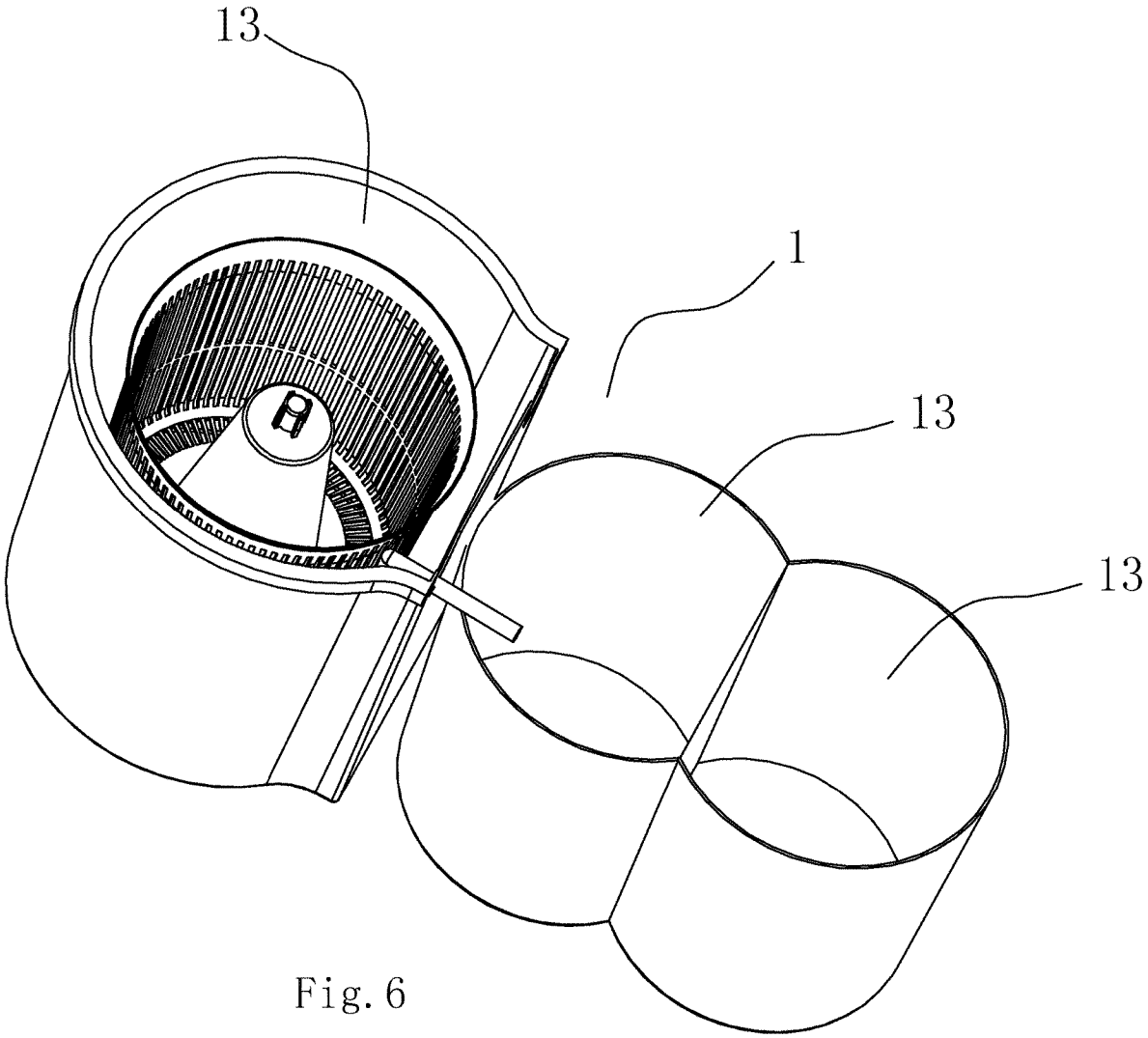
FIG. 6 is a perspective view of a bucket having a plurality of containers according to Embodiment 1 of the present invention.

In this embodiment, the bucket 1 has only one container 13. Of course, the bucket 1 can have a plurality of containers 13, as shown in FIG. 6, the rotatable dewatering frame 5 is provided within at least one container 13, and the water pumping device drains water out of the container 13 which has the dewatering frame 5 disposed therein.

Figure 5:
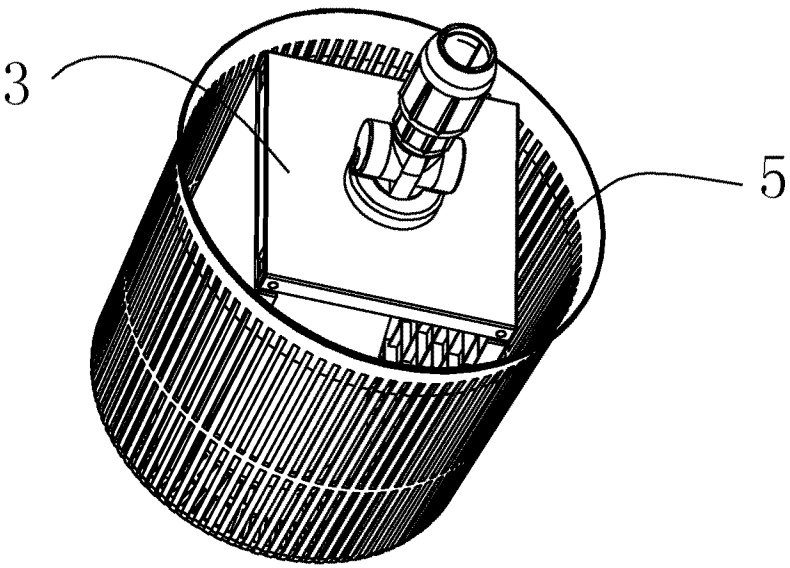
FIG. 5 is a perspective view of a mop head of a flat mop disposed inside the dewatering frame according to Embodiment 1 of the present invention.
Figure 4:
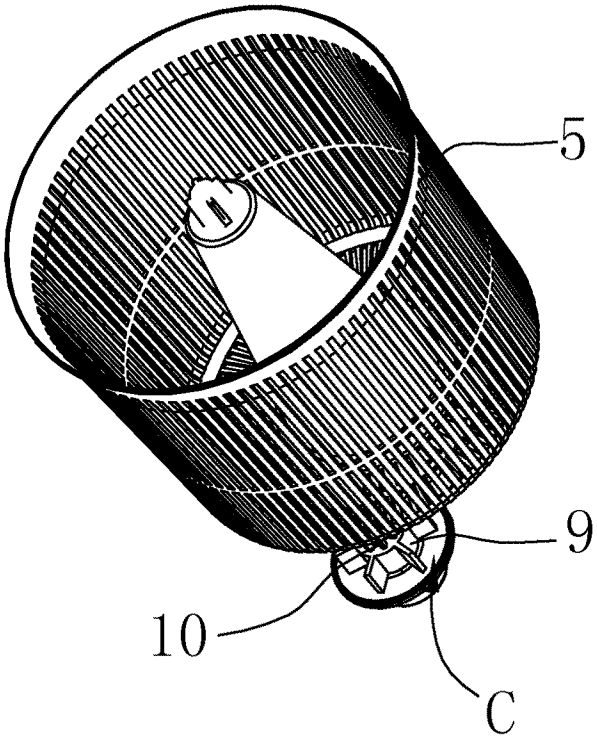
FIG. 4 is a perspective view of the water pumping device showing an internal structure thereof according to Embodiment 1 of the present invention.

When in use, the mop head 3 of the mop is put in the dewatering frame 5, and in this way, both cleaning and dewatering can be performed. FIG. 5 shows a case in which a flat mop is used. Of course, a mop having a disc-shaped mop head can also be used. During dewatering, there is no water within the bucket 1, and the mop head 3 of the mop is put in the dewatering frame 5. As in the prior art, the rod 2 is pressed so that the dewatering frame 5 and the mop head 3 are rotated for spin-drying. The spun water is maintained within the bucket 1, the water pumping device is driven by the drive mechanism 4, and water within the bucket 1 is pumped out by the water pumping device. Thus, the height of the bucket body can be reduced, and different from the bucket body in the prior art, it is unnecessary to provide a water storage space below the dewatering frame 5.

During cleaning, water is injected into the bucket 1, the mop head 3 of the mop is directly put in the dewatering frame 3, and the mop head 3 is immersed into water. As in the prior art, the rod 2 is pressed, and the mop head 3 and the dewatering frame 5 are rotated so that cleaning can be realized. Meanwhile, during cleaning, the water pumping device is driven by the drive mechanism 4, and water within the bucket 1 is pumped out by the water pumping device, so that the dewatering after cleaning can be realized.

Embodiment 2

Figure 8:
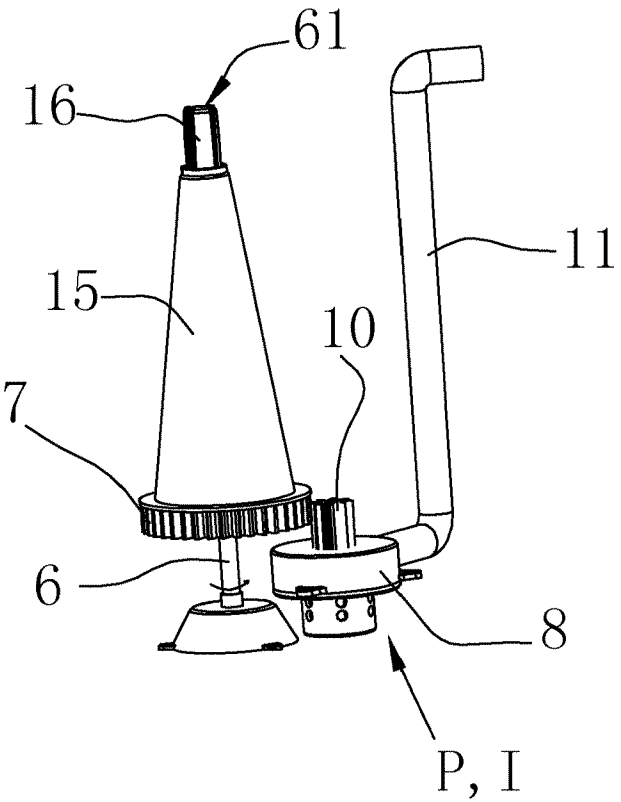
FIG. 8 is a perspective view of a water pumping device driven by a central shaft according to Embodiment 2 of the present invention.

As shown in FIG. 1 and FIG. 8, in this embodiment, the structure of the water pumping device P and the specific driving mode and structure of the drive mechanism 4 are as below.

The drive mechanism 4 drives the central shaft 6 to rotate, and the central shaft 6 then drives the water pumping device P to operate. A gear sleeve 15 is disposed on the central shaft 6 and the gear sleeve 15 has a driving gear 7; the water pumping device P is an impeller pump I, which includes a pump body 8 located within the bucket 1. The pump body 8 has a pump chamber communication with outside and an impeller 9 is disposed inside the pump chamber. A pump shaft is disposed in a center of the impeller 9. The pump shaft has a top extending out of a top of the pump body 8, and the pump shaft has a driven gear 10 on the top of the pump shaft, the driven gear 10 is engaged with the driving gear 7. The rotation of the central shaft 6 drives the driving gear 7 to rotate so as to drive the pump shaft and the impeller 9 to rotate through the driven gear 10, so that water pumping is realized and water can be drained through a water pumping pipe 11. The rotation of the central shaft 6 is driven by the drive mechanism 4. The way of driving the central shaft 6 to rotate by the drive mechanism 4 belongs to the conventional means in the art. For example, a cap 16 is disposed on the head 61 of the central shaft 6, a neck is provided on the back of the mop head 3, and the neck is stuck into the cap 16. The mop head 3 is connected to the inner rod of the rod 2. By pressing the rod, the inner rod of the rod drives the mop head 3 to rotate, and the mop head 3 drives the cap 16 and the central shaft 6 to rotate; or, the central shaft 6 is integrated with the dewatering frame 5, and the central shaft 6 is driven to rotate through the rotation of the dewatering frame 5. When the central shaft 6 is rotated, preferably, a socket sleeve 17 is provided on the bottom surface of the bucket 1, and the central shaft 6 is inserted into the socket sleeve 17; and a steel ball is provided on the bottom of the socket sleeve 17, and the lower end of the central shaft 6 is resisted against the steel ball, so that the rotation is more smooth and the central shaft 6 is more stable during rotation.

The remaining structures and implementations are the same as those in Embodiment 1 and will not be repeated here.

Embodiment 3

Figure 9:
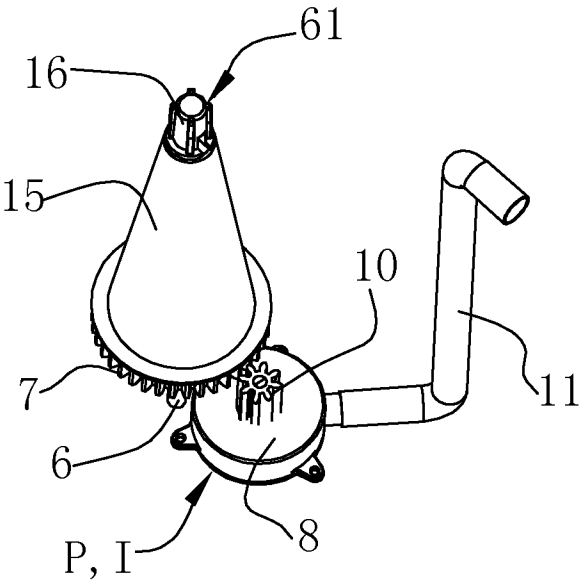
FIG. 9 is a perspective view of a cap driven by a drive mechanism according to Embodiment 3 of the present invention.

As shown in FIG. 1 and FIG. 9, in this embodiment, the structure of the water pumping device P and the specific driving mode and structure of the drive mechanism 4 are as below.

The central shaft 6 has a cap 16 disposed on the head 61 of central shaft 6, the drive mechanism 4 drives the cap 16 to rotate and the cap 16 then drives the water pumping device P to operate, and a gear sleeve 15 disposed on the central shaft 6 and under the cap 16 and the gear sleeve 15 has a driving gear 7; the water pumping device P is an impeller pump I, which includes a pump body 8 located within the bucket 1. The pump body 8 has a pump chamber communication with outside and an impeller 9 is disposed inside the pump chamber. A pump shaft is disposed in a center of the impeller 9. The pump shaft has a top extending out of a top of the pump body 8, and the pump shaft has a driven gear 10 on the top of the pump shaft, the driven gear 10 is engaged with the driving gear 7. The rotation of the central shaft 6 drives the driving gear 7 to rotate so as to drive the pump shaft and the impeller 9 to rotate through the driven gear 10, so that water pumping is realized and water can be drained through a water pumping pipe 11. The rotation of the cap 16 is driven by the drive mechanism 4. The way of driving the cap 16 to rotate by the drive mechanism 4 belongs to the conventional means in the art. In the conventional means in the art, the cap 16 is disposed on the central shaft 6 in general. For example, a neck is provided on the back of the mop head 3, and the neck is stuck into the cap 16. The mop head 3 is connected to the inner rod of the rod 2. By pressing the rod 2, the inner rod of the rod 2 drives the mop head 3 to rotate, and the mop head 3 drives the cap 16 to rotate.

The remaining structures and implementations are the same as those in Embodiment 1 and will not be repeated here.

Embodiment 4

Figure 10:
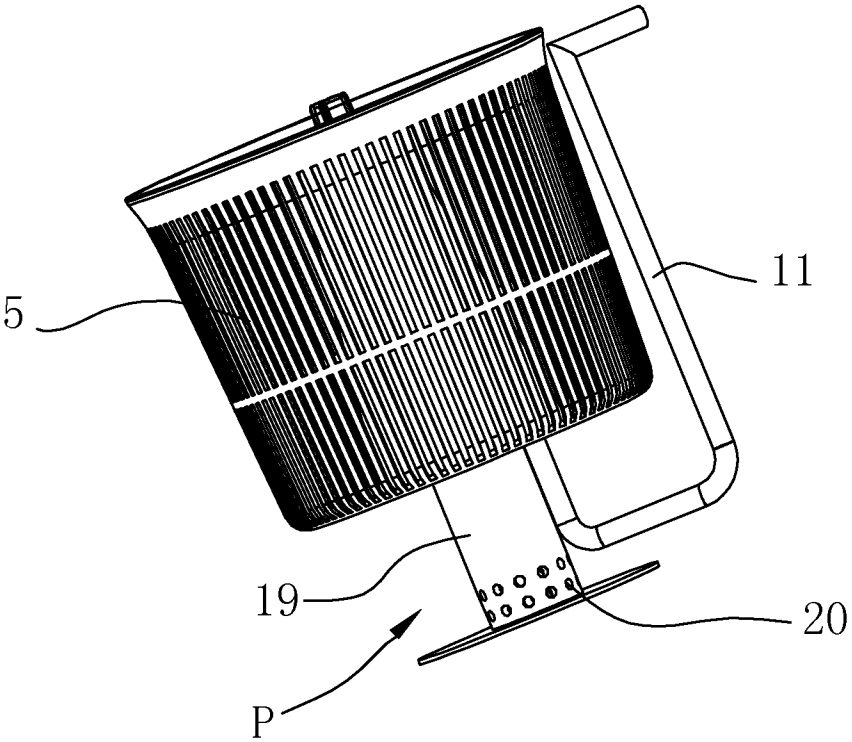
FIG. 10 is a perspective view of another water pumping device driven by the dewatering frame according to Embodiment 4 of the present invention.
Figure 11:
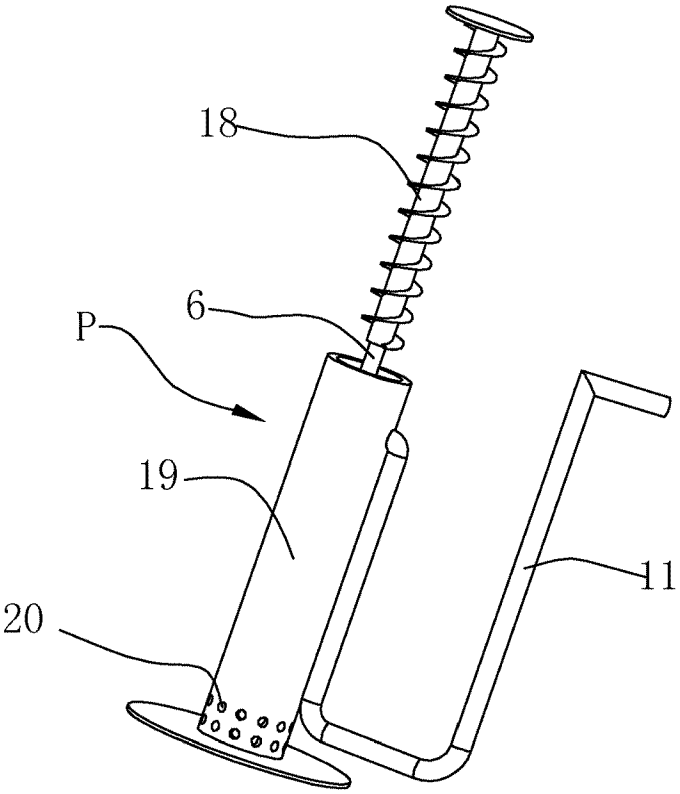
FIG. 11 is a perspective view of another water pumping device showing an internal structure thereof according to Embodiment 4 of the present invention.

As shown in FIG. 1, FIG. 10 and FIG. 11, in this embodiment, the structure of the water pumping device P and the specific driving mode and structure of the drive mechanism 4 are as below.

The drive mechanism 4 drives the dewatering frame 5 to rotate and the dewatering frame 5 then drives the water pumping device P to operate. The water pumping device P is a screw pump, which includes a pumping column 19 and a rotatable screw 18 disposed out of the central shaft 6 and inside the pumping column 19, the pumping column 19 has a bottom and the bottom of the pumping column 19 is connected with the bucket 1, the dewatering frame 5 has a bottom surface and the top of the screw 18 is connected with the bottom surface of the dewatering frame 5, so that the screw 18 can rotate together with the dewatering frame 5 and pump the water inside the pumping column 19 upwards; the pumping column 19 has a plurality of water pumping holes 20 located below the dewatering frame 5. To pump water out completely, the water pumping holes 20 are located on the bottom of the pumping column 19.

The rotation of the dewatering frame 5 drives the rotatable screw 18 to rotate, and the rotation of the rotatable screw 18 pumps the water inside the pumping column 19 through water pumping holes 20, so that water pumping is realized and water can be drained through a water pumping pipe 11. The rotation of the dewatering frame 5 is driven by the drive mechanism 4. The way of driving the dewatering frame 5 by the drive mechanism 4 belongs to the conventional means in the art and this function can be realized by existing cleaning tools, and thus will not be repeated here.

The remaining structures and implementations are the same as those in Embodiment 1 and will not be repeated here.

Embodiment 5

Figure 12:
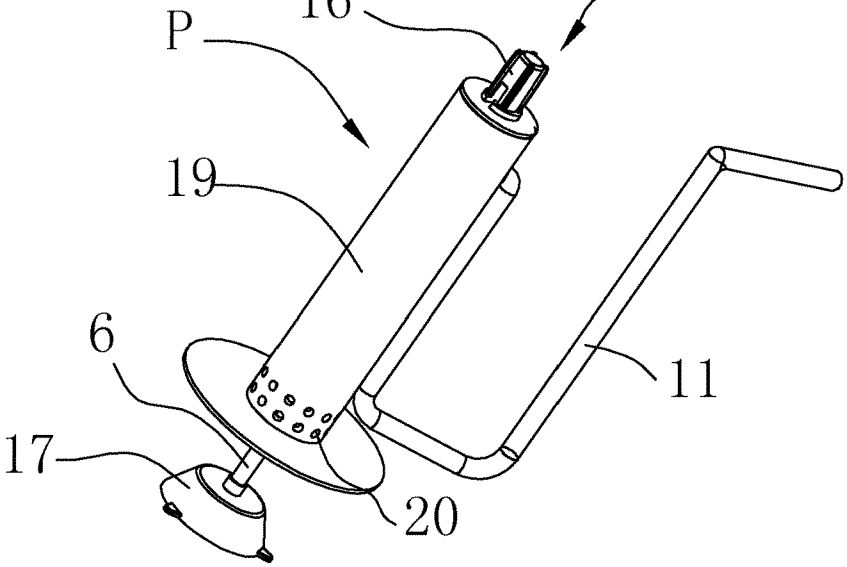
FIG. 12 is a perspective view of another water pumping device driven by a central shaft according to Embodiment 5 of the present invention.

As shown in FIG. 1 and FIG. 12, in this embodiment, the structure of the water pumping device and the specific driving mode and structure of the drive mechanism 4 are as below.

The drive mechanism 4 drives the central shaft 6 to rotate and the central shaft 6 then drives the water pumping device P to operate. The water pumping device P is a screw pump, which includes a pumping column 19 and a screw 18 disposed on the central shaft 6 rotatably with the central shaft 6 and inside the pumping column 19, the pumping column 19 has a bottom and the bottom of the pumping column 19 is connected with the bucket 1. so that the screw 18 can rotate together with the central shaft 6 and pump the water inside the pumping column 19 upwards; the pumping column 19 has a plurality of water pumping holes 20 located below the dewatering frame 5. To pump water out completely, the water pumping holes 20 are located on the bottom of the pumping column 19.

The rotation of the central shaft 6 drives the rotatable screw 18 to rotate, and the rotation of the rotatable screw 18 pumps the water inside the pumping column 19 through water pumping holes 20, so that water pumping is realized and water can be drained through a water pumping pipe 11. The rotation of the central shaft 6 is driven by the drive mechanism 4. The way of driving the central shaft 6 to rotate by the drive mechanism 4 belongs to the conventional means in the art. For example, a cap 16 is disposed on the head 61 of the central shaft 6, a neck is provided on the back of the mop head 3, and the neck is stuck into the cap 16. The mop head 3 is connected to the inner rod of the rod 2. By pressing the rod, the inner rod of the rod drives the mop head 3 to rotate, and the mop head 3 drives the cap 16 and the central shaft 6 to rotate; or, the central shaft 6 is integrated with the dewatering frame 5, and the central shaft 6 is driven to rotate through the rotation of the dewatering frame 5. When the central shaft 6 is rotated, preferably, a socket sleeve 17 is provided on the bottom surface of the bucket 1, and the central shaft 6 is inserted into the socket sleeve 17; and a steel ball is provided on the bottom of the socket sleeve 17, and the lower end of the central shaft 6 is resisted against the steel ball, so that the rotation is more smooth and the central shaft 6 is more stable during rotation.

The remaining structures and implementations are the same as those in Embodiment 1 and will not be repeated here.

Embodiment 6

Figure 13:
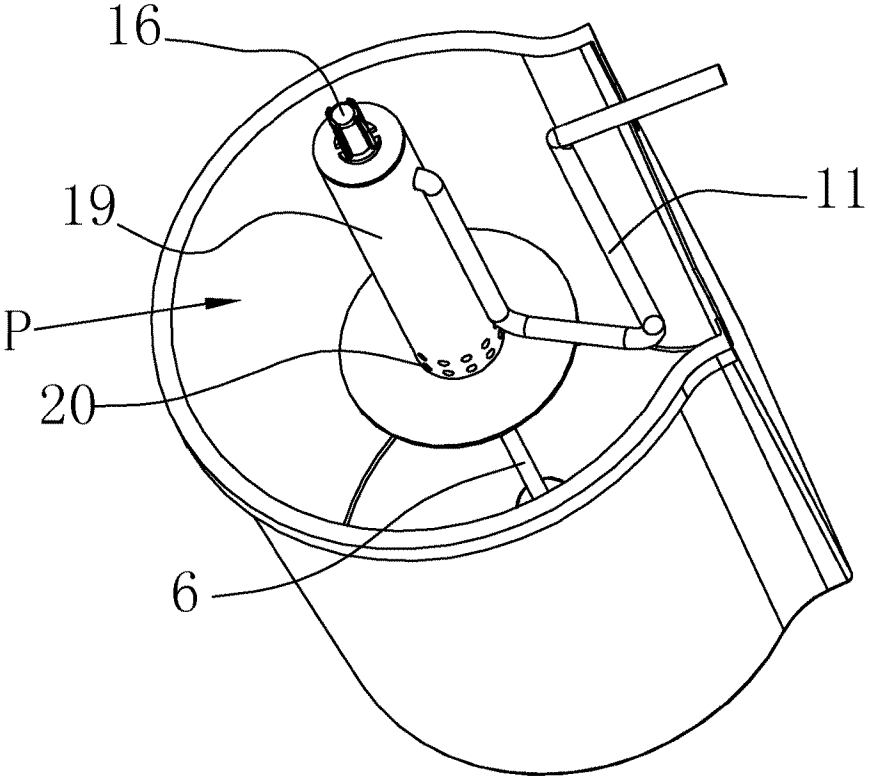
FIG. 13 is a perspective view of another water pumping device driven by the cap according to Embodiment 6 of the present invention.

As shown in FIG. 1 and FIG. 13, in this embodiment, the structure of the water pumping device and the specific driving mode and structure of the drive mechanism 4 are as below.

The central shaft 6 has a cap 16 disposed on the head of central shaft 6, the drive mechanism 4 drives the cap 16 to rotate and the cap 16 then drives the water pumping device P to operate. The water pumping device P is a screw pump, which includes a pumping column 19 and a screw 18 disposed on the cap 16 rotatably with the central shaft 6 and inside the pumping column 19, the pumping column 19 has a bottom and the bottom of the pumping column 19 is connected with the bucket 1, so that the screw 18 can rotate together with the cap 16 and pump the water inside the pumping column 19 upwards; the pumping column 19 has a plurality of water pumping holes 20 located below the dewatering frame 5. To pump water out completely, the water pumping holes 20 are located on the bottom of the pumping column 19.

The rotation of the cap 16 drives the rotatable screw 18 to rotate, and the rotation of the rotatable screw 18 pumps the water inside the pumping column 19 through water pumping holes 20, so that water pumping is realized and water can be drained through a water pumping pipe 11. The rotation of the cap 16 is driven by the drive mechanism 4. The way of driving the cap 16 to rotate by the drive mechanism 4 belongs to the conventional means in the art. In the conventional means in the art, the cap 16 is disposed on the central shaft 6 in general. For example, a neck is provided on the back of the mop head 3, and the neck is stuck into the cap 16. The mop head 3 is connected to the inner rod of the rod 2. By pressing the rod 2, the inner rod of the rod 2 drives the mop head 3 to rotate, and the mop head 3 drives the cap 16 to rotate.

The remaining structures and implementations are the same as those in Embodiment 1 and will not be repeated here.

Embodiment 7

Figure 14:
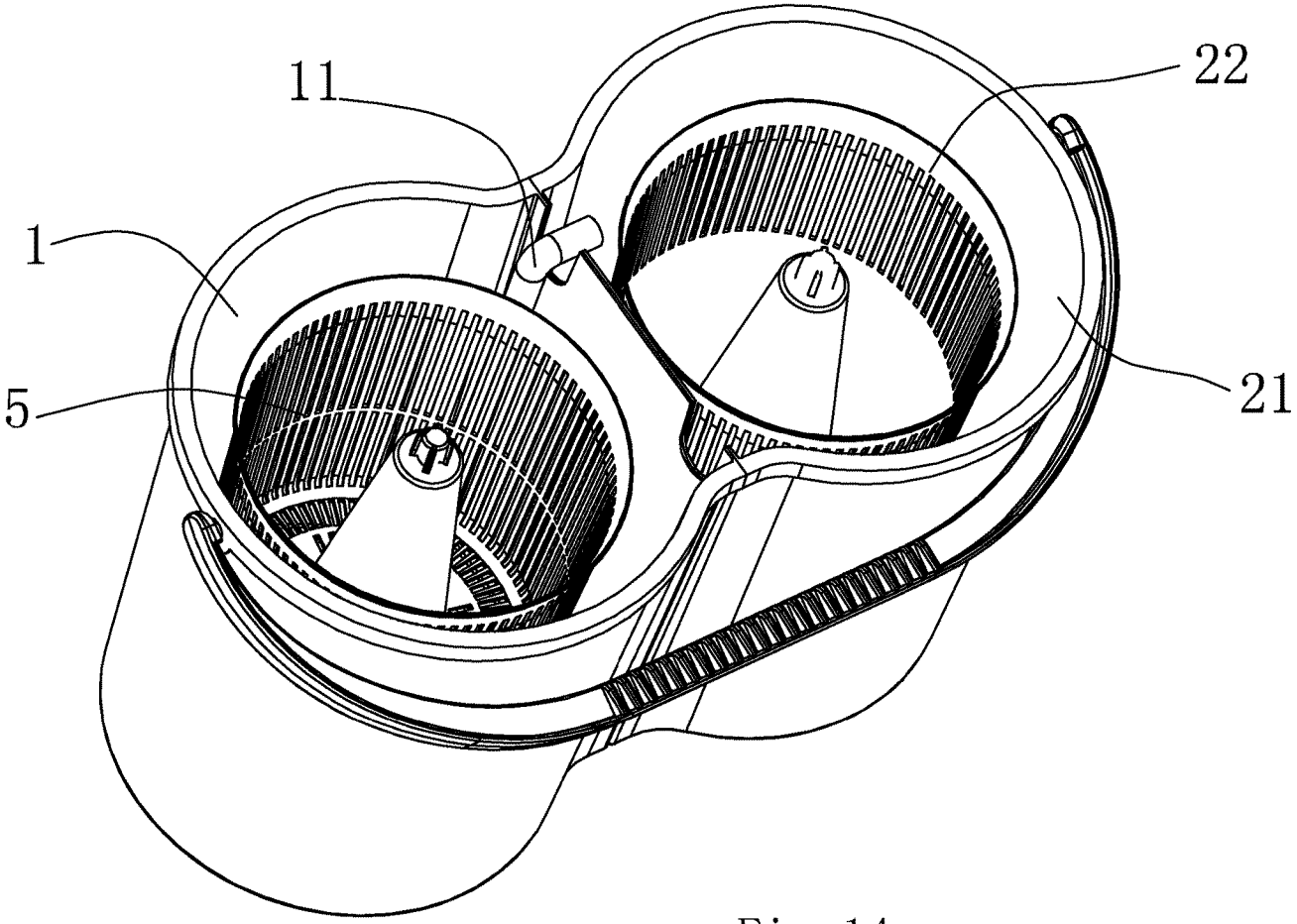
FIG. 14 is a perspective view of a cleaning tool set with a cleaning bucket according to Embodiment 7 of the present invention.

As shown in FIG. 1 and FIG. 14, the cleaning tool set further comprises a cleaning bucket 21 having a cleaning basket 22 disposed in the cleaning bucket 21, a cleaning spindle is provided in the center of the cleaning basket 22, and the cleaning basket 22 is mounted inside the cleaning bucket 21 through the cleaning spindle. The connection between the cleaning basket 22 and the cleaning spindle and the connection between the cleaning spindle and the cleaning bucket 21 belongs to the conventional means in the art and will not be repeated here.

As described above, both dewatering and cleaning can be performed within the bucket 1, and the water pumping device can pump water within the bucket 1 to the cleaning bucket 21. Cleaning can be performed within the cleaning bucket 21. The mop head 3 of the mop is directly put in the cleaning basket 22 and then immersed into water. As in the prior art, the rod 2 is pressed to drive the cleaning basket 22 and the mop head 3 to rotate so that the cleaning can be realized. Water within the cleaning bucket 21 can be transferred from the bucket 1, and thus water saving is realized.

The remaining structures and implementations are the same as anyone of Embodiment 1-6 and will not be repeated here.

Embodiment 8

Figure 15:
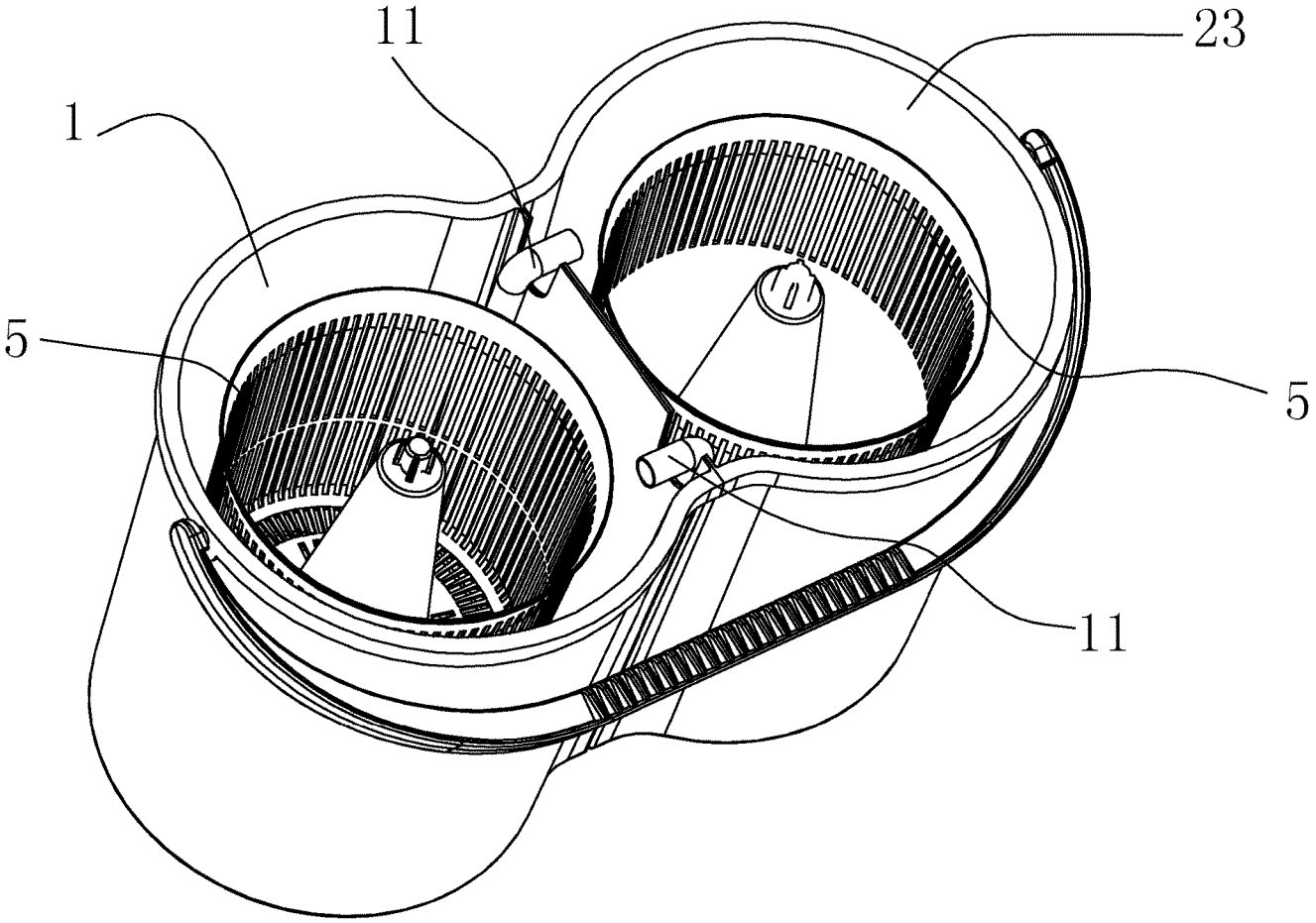
FIG. 15 is a perspective view of a cleaning tool set with a cleaning and dewatering bucket according to Embodiment 8 of the present invention.

As shown in FIG. 1 and FIG. 15, the cleaning tool set further comprises a cleaning and dewatering bucket 23, which also has the dewatering frame 5 and the water pumping device disposed in; the water pumping device of the bucket 1 can drain water to the cleaning and dewatering bucket 23, and the water pumping device in the cleaning and dewatering bucket 23 can drain water to the container 13 with the dewatering frame 5.

In this embodiment, it is equivalent to provide two same buckets 1. Both dewatering and cleaning can be performed in either the bucket 1 or the cleaning and dewatering bucket 23. Water within the bucket 1 can be transferred to the cleaning and dewatering bucket 23, and water within the cleaning and dewatering bucket 23 can be transferred to the bucket 1.

The remaining structures and implementations are the same as anyone of Embodiment 1-6 and will not be repeated here.

Embodiment 9

In the above embodiments, the water pumping is realized by mechanical drive. In this embodiment, the water pumping is realized by a water pump and the operation of the water pump is controlled by a switch.

Figure 16:
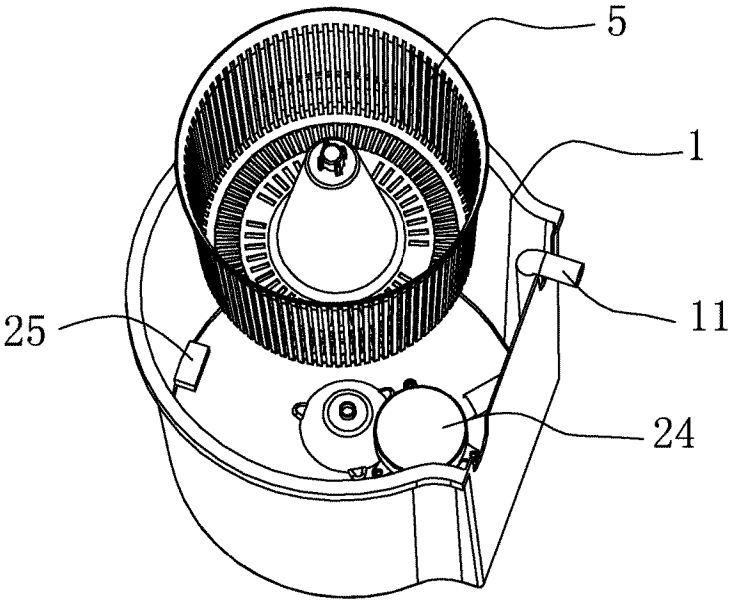
FIG. 16 is a perspective view of a cleaning tool set with a water pump according to Embodiment 9 of the present invention.

As shown in FIG. 1 and FIG. 16, the cleaning tool set comprises a rod 2; a mop head 3 attached to the rod 2; a wiper attached to the mop head 3, the rod 2, the mop head 3, and the wiper forming a mop; and a bucket 1 for receiving the mop.

The rod 2 comprises an inner rod, an outer rod sleeved at least partially over the inner rod. The mop head 3 is connected at the lower end of the inner rod, and a drive mechanism 4 is disposed between the inner rod and the outer rod for converting a telescopic motion between the inner rod and an outer rod into a rotating motion of the rod 2 (if the inner rod is on the top while the outer rod is on the bottom, the mop head 3 is connected at the lower end of the outer rod and the telescopic motion of the rod 2 is converted into the rotating motion of the inner rod; however, in practices, it is basically impossible to employ a structure in which the inner rod is on the top while the outer rod is on the bottom). The specific structure form of the drive mechanism 4 belongs to the conventional means in the art and will not be repeated here.

The bucket 1 comprises at least one container 13, a rotatable dewatering frame 5 with a central shaft 6 disposed inside the at least one container 13. In this embodiment, the bucket 1 has only one container 13, and the bucket 1 itself is the container 13.

A water pump 24 having a water inlet is disposed inside the at least one container 13 having the rotatable dewatering frame 5, the water inlet of the water pump is located below the dewatering frame 5, a switch for operating the water pump 24 is disposed inside the at least one container 13 having the dewatering frame 5; and the water pump drains water in the at least one container 13 having the dewatering frame 5. To pump water out completely, the water pumping device is located on the bottom of the bucket 1.

In this embodiment, switch is a water level switch 25 located below the dewatering frame 5, and the water level switch 25 is located within the container 13 having the dewatering frame 5 disposed therein. Due to the mounting of the water level switch 25, only dewatering can be performed inside the bucket 1. During dewatering, water level rises to the water level switch 25, the water level switch 25 engages the water pump 24 to start pumping, so that water can be drained through a water pumping pipe 11.

In this embodiment, the water pump 24 is located within the bucket body. Of course, a self-priming pump or the like can also be used. In this case, the water pumping 24 can be mounted outside the bucket body.

In this embodiment, the bucket 1 has only one container 13. Of course, the bucket 1 can have a plurality of containers 13, the rotatable dewatering frame 5 is provided within at least one container 13, and the water pumping 24 drains water out of the container 13 which has the dewatering frame 5 disposed therein.

Embodiment 10

The switch is a float switch located below the dewatering frame 5, and the float switch is located within the container 13 having the dewatering frame 5 disposed therein. Due to the mounting of the float switch, only dewatering can be performed inside the bucket 1. During dewatering, water level rises to the float switch, the float switch engages the water pump 24 to start pumping.

The remaining structures and implementations are the same as those in Embodiment 9 and will not be repeated here.

Embodiment 11

The switch is an ordinary switch located on the outer surface of the bucket 1, and in this way, both cleaning and dewatering can be performed inside the bucket 1. The pumping of the water pump 24 can be directly realized by operating the ordinary switch.

The remaining structures and implementations are the same as those in Embodiment 9 and will not be repeated here.

Embodiment 12

The cleaning tool set further comprises a cleaning bucket 21 having a cleaning basket 22 disposed in the cleaning bucket 21, a cleaning spindle is provided in the center of the cleaning basket 22, and the cleaning basket 22 is mounted inside the cleaning bucket 21 through the cleaning spindle.

Cleaning can be performed within the cleaning bucket 21. The mop head 3 of the mop is directly put in the cleaning basket 22 and then immersed into water. As in the prior art, the rod 2 is pressed to drive the cleaning basket 22 and the mop head 3 to rotate so that the cleaning can be realized. Water within the cleaning bucket 21 can be transferred from the bucket 1, and thus water saving is realized.

The remaining structures and implementations are the same as anyone of Embodiment 9-11 and will not be repeated here.

Embodiment 13

The cleaning tool set further comprises a cleaning and dewatering bucket 23, which also has the dewatering frame 5, the water pump 24 and the switch disposed therein; water pump 24 of the bucket 1 can drain water to the cleaning and dewatering bucket 23, and the water pump 24 in the cleaning and dewatering bucket 23 can drain water to the container 13 with the dewatering frame 5.

In this embodiment, it is equivalent to provide two same buckets 1. Both dewatering and cleaning can be performed in either the bucket 1 or the cleaning and dewatering bucket 23. Water within the bucket 1 can be transferred to the cleaning and dewatering bucket 23, and water within the cleaning and dewatering bucket 23 can be transferred to the bucket 1.

The remaining structures and implementations are the same as anyone of Embodiment 9-11 and will not be repeated here.

Embodiment 14

Figure 17:
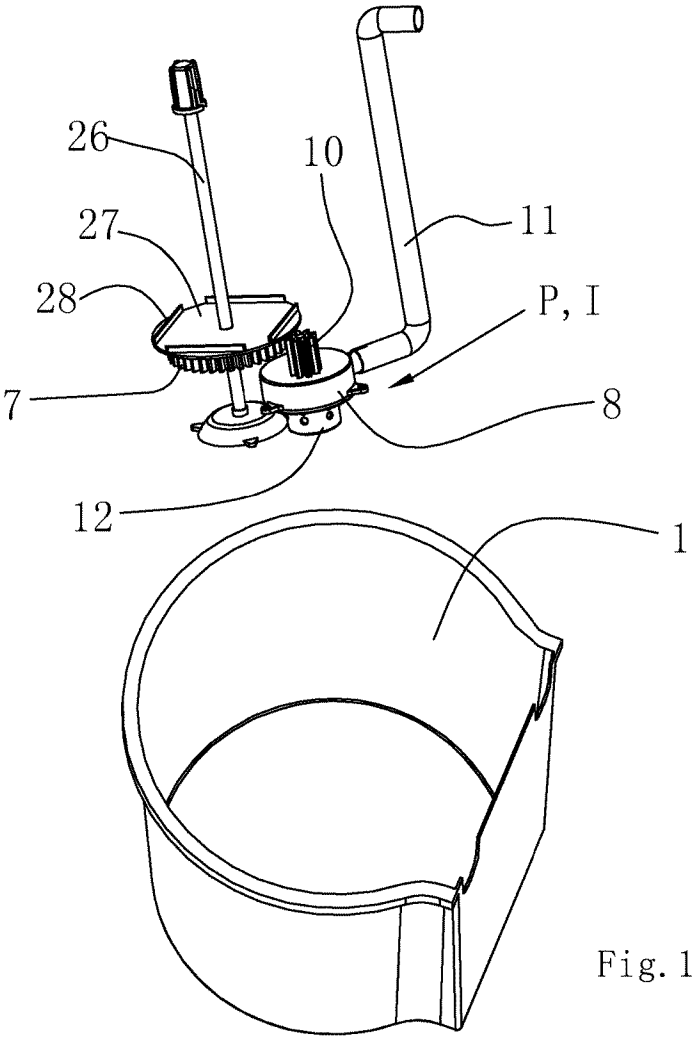
FIG. 17 is a perspective view of a cleaning tool set according to Embodiment 14 of the present invention.

As shown in FIG. 1 and FIG. 17, the cleaning tool set comprises a rod 2; a mop head 3 attached to the rod 2; a wiper attached to the mop head 3, the rod 2, the mop head 3, and the wiper forming a mop; and a bucket 1 for receiving the mop.

The rod 2 comprises an inner rod, an outer rod sleeved at least partially over the inner rod. The mop head 3 is connected at the lower end of the inner rod, and a drive mechanism 4 is disposed between the inner rod and the outer rod for converting a telescopic motion between the inner rod and an outer rod into a rotating motion of the rod 2 (if the inner rod is on the top while the outer rod is on the bottom, the mop head is connected at the lower end of the outer rod and the telescopic motion of the rod 2 is converted into the rotating motion of the inner rod; however, in practices, it is basically impossible to employ a structure in which the inner rod is on the top while the outer rod is on the bottom). The specific structure form of the drive mechanism 4 belongs to the conventional means in the art and will not be repeated here.

The bucket 1 comprises at least one container 13. In this embodiment, the bucket 1 has only one container 13, and the bucket 1 itself is the container 13. A rotating shaft 26 with a rotating plate 27 is disposed inside the bucket 1, and the rotating plate 27 has a plurality of retaining ribs 28 for the mop head 3 to resist against.

When the mop head 3 engages the rotating shaft 26, the mop head 3 rotates the rotating plate 27, and the water pumping device P is driven by the rotating plate 27 to drain water out of at least one container 13 which has the rotating shaft 26 disposed therein; the water inlet of the water pumping device is located below the mop head (3) when the mop head 3 is located on the rotating shaft 26.

In this embodiment, the structure of the water pumping device P and the specific driving mode and structure of the rotating plate 27 are as below. A driving gear 7 is disposed on the bottom surface of the rotating plate 27. The water pumping device P is an impeller pump I, which includes a pump body 8. The pump body 8 has a pump chamber in communication with outside and an impeller 9 is disposed inside the pump chamber. A pump shaft is disposed in a center of the impeller 9. The pump shaft has a top extending out of a top of the pump body 8, and the pump shaft has a driven gear 10 on the top of the pump shaft, the driven gear 10 is engaged with the driving gear 7. The rotation of the rotating plate 27 drives the driving gear 7 to rotate so as to drive the pump shaft and the impeller 9 to rotate through the driven gear 10, so that water pumping is realized and water can be drained through a water pumping pipe 11.

To pump water out completely, the water pumping device P is located on the bottom of the bucket 1. In other words, the pump body 8 is located on the bottom of the bucket 1. The bottom of the pump body 8 can be extended downward to form a downward extension drum 12, and an opening is formed on the downward extension drum 12, so that water is pumped out through the opening. Water is pumped out more completely after the downward extension drum 12 is provided. The water pumping pipe 11 can be extended from the upper end of the bucket 1, or can be directly extended from the bottom of the bucket 1. A row of water outlets can be provided on the bottom of a side wall of the bucket 1. Plugs 14 are provided within the water outlets. The water outlets are plugged by the plugs 14 when water pumping is not required.

In this embodiment, an impeller pump is used. Of course, it is also possible to use a gear pump, a displacement pump or the like. When a gear pump, a displacement pump or the like is used, as described in this embodiment, it is also possible to rotate the rotating plate 27 so as to transfer power into the pump through the drive mechanism 4. The form of the drive mechanism 4 can be a gear drive mechanism as described in this embodiment, or can be other power transmission mechanisms. The designs of such a drive mechanism can be easily realized by those skilled in the art, and will not be enumerated.

In this embodiment, an impeller pump is used, and thus, the water pumping device P is located within the bucket body. Of course, a self-priming pump or the like can also be used. In this case, the water pumping device P can be mounted outside the bucket body.

In this embodiment, the bucket 1 has only one container 13. Of course, the bucket 1 can have a plurality of containers 13, the rotating shaft 26 is provided within at least one container 13, and the water pumping device P drains water out of the container 13 which has the rotating shaft 26 disposed therein.

During dewatering, as in the prior art, the rod 2 is pressed so that the dewatering frame 5 and the mop head 3 are rotated for spin-drying. The water within the bucket 1 is pumped out by the water pumping device P. Thus, the height of the bucket body can be reduced, and different from the bucket body in the prior art, it is unnecessary to provide a water storage space below the dewatering basket.

During cleaning, water is injected into the bucket 1. As in the prior art, the rod 2 is pressed, and the mop head 3 and the dewatering frame 5 are rotated so that cleaning can be realized. Meanwhile, during cleaning, the water pumping device P is driven by the drive mechanism 4, and water within the bucket 1 is pumped out by the water pumping device P, so that the dewatering after cleaning can be realized.

Embodiment 15

Figure 18:
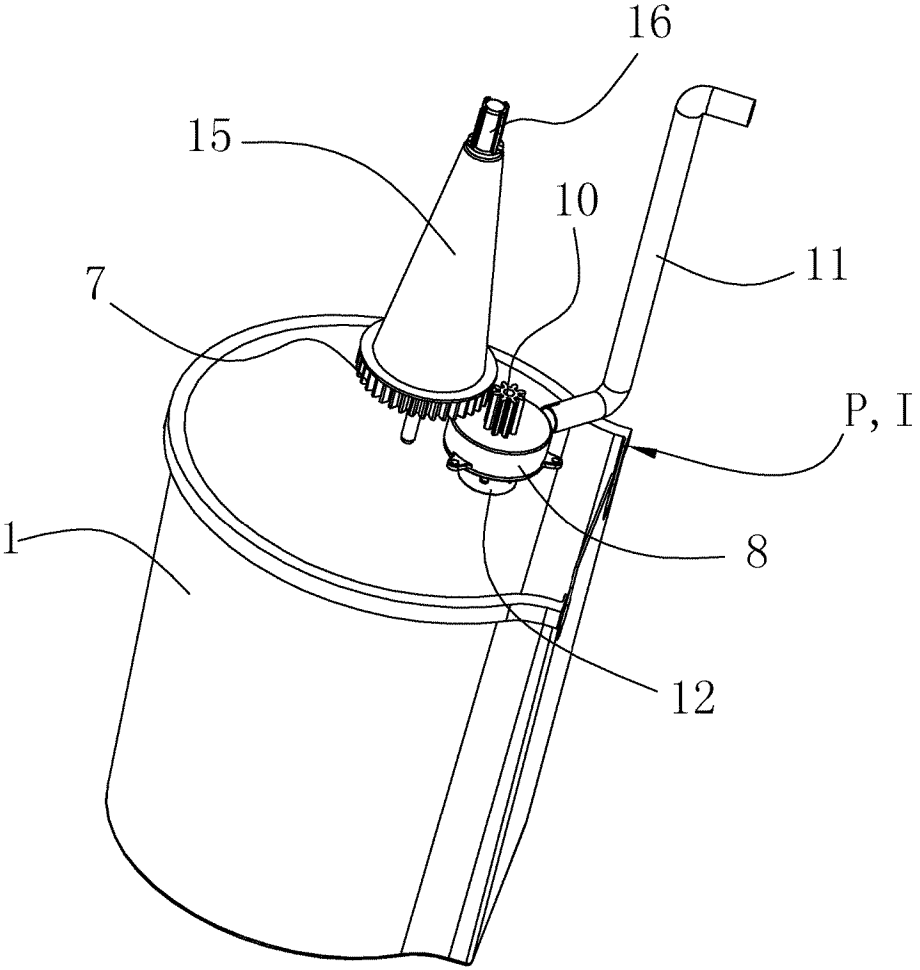
FIG. 18 is a perspective view of a cleaning tool set according to Embodiment 15 of the present invention.

As shown in FIG. 1 and FIG. 18, the cleaning tool set comprises a rod 2; a mop head 3 attached to the rod 2; a wiper attached to the mop head 3, the rod 2, the mop head 3, and the wiper forming a mop; and a bucket 1 for receiving the mop.

The rod 2 comprises an inner rod, an outer rod sleeved at least partially over the inner rod. The mop head 3 is connected at the lower end of the inner rod, and a drive mechanism 4 is disposed between the inner rod and the outer rod for converting a telescopic motion between the inner rod and an outer rod into a rotating motion of the rod 2 (if the inner rod is on the top while the outer rod is on the bottom, the mop head is connected at the lower end of the outer rod and the telescopic motion of the rod 2 is converted into the rotating motion of the inner rod; however, in practices, it is basically impossible to employ a structure in which the inner rod is on the top while the outer rod is on the bottom). The specific structure form of the drive mechanism 4 belongs to the conventional means in the art and will not be repeated here.

The bucket 1 comprises at least one container 13. In this embodiment, the bucket 1 has only one container 13, and the bucket 1 itself is the container 13. A rotating shaft 26 with a cap 16 disposed on a head of the rotating shaft is disposed inside the at least one container 13.

When the mop head 3 engages the cap 16, the drive mechanism 4 drives the cap 16 to rotate; and the water pumping device P is driven by the cap 16 to drain water out of the at least one container 13 with the rotating shaft 26; the water inlet of the water pumping device P is located below the mop head 3 when the mop head 3 engages the cap 16.

In this embodiment, the structure of the water pumping device P and the specific driving mode and structure of the cap 16 are as below. The drive mechanism 4 drives the cap 16 to rotate, and the cap 16 then drives the water pumping device P to operate. A gear sleeve 15 is disposed on the central shaft 6 and under the cap 16 and the gear sleeve 15 has a driving gear 7; the water pumping device P is an impeller pump I, which includes a pump body 8 located within the bucket 1. The pump body 8 has a pump chamber communication with outside and an impeller 9 is disposed inside the pump chamber. A pump shaft is disposed in a center of the impeller 9. The pump shaft has a top extending out of a top of the pump body 8, and the pump shaft has a driven gear 10 on the top of the pump shaft, the driven gear 10 is engaged with the driving gear 7. The rotation of the central shaft 6 drives the driving gear 7 to rotate so as to drive the pump shaft and the impeller 9 to rotate through the driven gear 10, so that water pumping is realized and water can be drained through a water pumping pipe 11. The rotation of the cap 16 is driven by the drive mechanism 4. The way of driving the cap 16 to rotate by the drive mechanism 4 belongs to the conventional means in the art. In the conventional means in the art, the cap 16 is disposed on the central shaft 6 in general. For example, a neck is provided on the back of the mop head 3, and the neck is stuck into the cap 16. The mop head 3 is connected to the inner rod of the rod 2. By pressing the rod 2, the inner rod of the rod 2 drives the mop head 3 to rotate, and the mop head 3 drives the cap 16 to rotate.

To pump water out completely, the water pumping device P is located on the bottom of the bucket 1. In other words, the pump body 8 is located on the bottom of the bucket 1. The bottom of the pump body 8 can be extended downward to form a downward extension drum 12, and an opening is formed on the downward extension drum 12, so that water is pumped out through the opening. Water is pumped out more completely after the downward extension drum 12 is provided. The water pumping pipe 11 can be extended from the upper end of the bucket 1, or can be directly extended from the bottom of the bucket 1. A row of water outlets can be provided on the bottom of a side wall of the bucket 1. Plugs 14 are provided within the water outlets. The water outlets are plugged by the plugs 14 when water pumping is not required.

In this embodiment, an impeller pump is used. Of course, it is also possible to use a gear pump, a displacement pump or the like. When a gear pump, a displacement pump or the like is used, as described in this embodiment, it is also possible to rotate the rotating plate 27 so as to transfer power into the pump through the drive mechanism 4. The form of the drive mechanism 4 can be a gear drive mechanism as described in this embodiment, or can be other power transmission mechanisms. The designs of such a drive mechanism can be easily realized by those skilled in the art, and will not be enumerated.

In this embodiment, an impeller pump is used, and thus, the water pumping device P is located within the bucket body. Of course, a self-priming pump or the like can also be used. In this case, the water pumping device P can be mounted outside the bucket body.

In this embodiment, the bucket 1 has only one container 13. Of course, the bucket 1 can have a plurality of containers 13, the rotating shaft 26 is provided within at least one container 13, and the water pumping device P drains water out of the container 13 which has the rotating shaft 26 disposed therein.

During dewatering, as in the prior art, the rod 2 is pressed so that the dewatering frame 5 and the mop head 3 are rotated for spin-drying. The water within the bucket 1 is pumped out by the water pumping device P. Thus, the height of the bucket body can be reduced, and different from the bucket body in the prior art, it is unnecessary to provide a water storage space below the dewatering basket.

During cleaning, water is injected into the bucket 1. As in the prior art, the rod 2 is pressed, and the mop head 3 and the dewatering frame 5 are rotated so that cleaning can be realized. Meanwhile, during cleaning, the water pumping device P is driven by the drive mechanism 4, and water within the bucket 1 is pumped out by the water pumping device P, so that the dewatering after cleaning can be realized.

Embodiment 16

Figure 19:
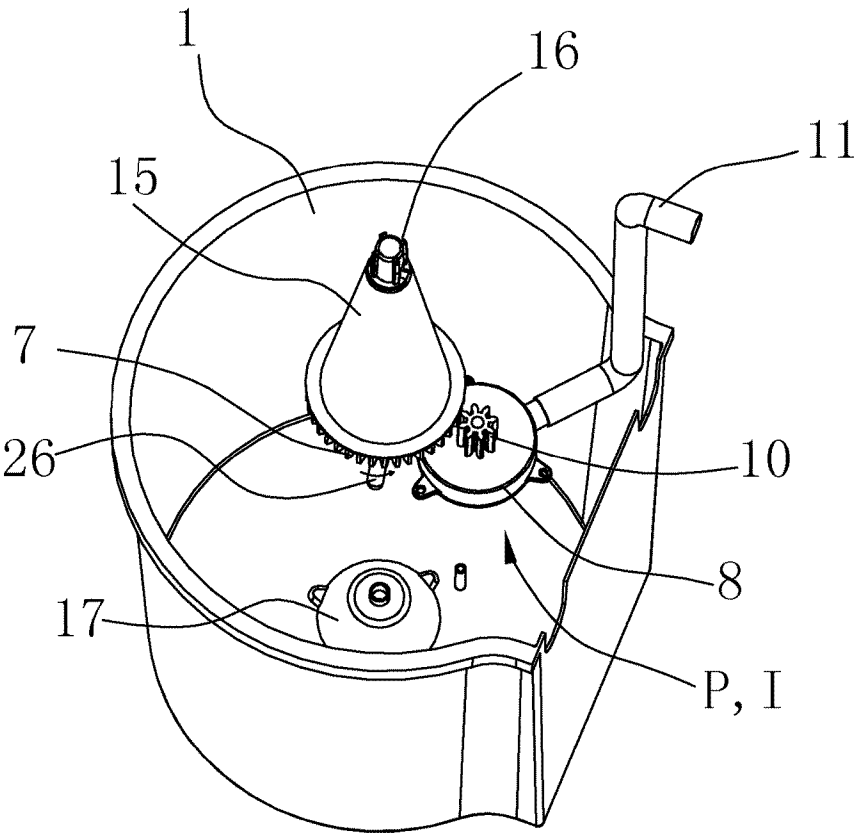
FIG. 19 is a perspective view of a cleaning tool set according to Embodiment 16 of the present invention.

As shown in FIG. 1 and FIG. 19, the cleaning tool set comprises a rod 2; a mop head 3 attached to the rod 2; a wiper attached to the mop head 3, the rod 2, the mop head 3, and the wiper forming a mop; and a bucket 1 for receiving the mop.

The rod 2 comprises an inner rod, an outer rod sleeved at least partially over the inner rod. The mop head 3 is connected at the lower end of the inner rod, and a drive mechanism 4 is disposed between the inner rod and the outer rod for converting a telescopic motion between the inner rod and an outer rod into a rotating motion of the rod 2 (if the inner rod is on the top while the outer rod is on the bottom, the mop head is connected at the lower end of the outer rod and the telescopic motion of the rod 2 is converted into the rotating motion of the inner rod; however, in practices, it is basically impossible to employ a structure in which the inner rod is on the top while the outer rod is on the bottom). The specific structure form of the drive mechanism 4 belongs to the conventional means in the art and will not be repeated here.

The bucket 1 comprises at least one container 13 and a water pumping device P having a water inlet. In this embodiment, the bucket 1 has only one container 13, and the bucket 1 itself is the container 13. A rotating shaft 26 is disposed inside the at least one container 13.

When the mop head 3 engages the rotating shaft 26, the drive mechanism 4 drives the rotating shaft 26 to rotate; and the water pumping device P is driven by the rotating shaft 26 to drain water out of the at least one container 13 with the rotating shaft 26; the water inlet of the water pumping device P is located below the mop head 3 when the mop head 3 engages the rotating shaft 26.

In this embodiment, the structure of the water pumping device P is the specific driving mode and structure of the rotating shaft 26. A gear sleeve 15 is disposed on the rotating shaft 26 and the gear sleeve 15 has a driving gear 7; the water pumping device P is an impeller pump I, which includes a pump body 8 located within the bucket 1. The pump body 8 has a pump chamber communication with outside and an impeller 9 is disposed inside the pump chamber. A pump shaft is disposed in a center of the impeller 9. The pump shaft has a top extending out of a top of the pump body 8, and the pump shaft has a driven gear 10 on the top of the pump shaft, the driven gear 10 is engaged with the driving gear 7. The rotation of the rotating shaft 26 drives the driving gear 7 to rotate so as to drive the pump shaft and the impeller 9 to rotate through the driven gear 10, so that water pumping is realized and water can be drained through a water pumping pipe 11. The rotation of the rotating shaft 26 is driven by the drive mechanism 4. The way of driving the rotating shaft 26 to rotate by the drive mechanism 4 belongs to the conventional means in the art. For example, a cap 16 is disposed on the head of the rotating shaft 26, a neck is provided on the back of the mop head 3, and the neck is stuck into the cap 16. The mop head 3 is connected to the inner rod of the rod 2. By pressing the rod, the inner rod of the rod drives the mop head 3 to rotate, and the mop head 3 drives the cap 16 and the rotating shaft 26 to rotate; when the rotating shaft 26 is rotated, preferably, a socket sleeve 17 is provided on the bottom surface of the bucket 1, and the rotating shaft 26 is inserted into the socket sleeve 17; and a steel ball is provided on the bottom of the socket sleeve 17, and the lower end of the central shaft 6 is resisted against the steel ball, so that the rotation is more smooth and the rotating shaft 26 is more stable during rotation.

To pump water out completely, the water pumping device P is located on the bottom of the bucket 1. In other words, the pump body 8 is located on the bottom of the bucket 1. The bottom of the pump body 8 can be extended downward to form a downward extension drum 12, and an opening is formed on the downward extension drum 12, so that water is pumped out through the opening. Water is pumped out more completely after the downward extension drum 12 is provided. The water pumping pipe 11 can be extended from the upper end of the bucket 1, or can be directly extended from the bottom of the bucket 1. A row of water outlets can be provided on the bottom of a side wall of the bucket 1. Plugs 14 are provided within the water outlets. The water outlets are plugged by the plugs 14 when water pumping is not required.

In this embodiment, an impeller pump I is used. Of course, it is also possible to use a gear pump, a displacement pump or the like. When a gear pump, a displacement pump or the like is used, as described in this embodiment, it is also possible to rotate the rotating plate 27 so as to transfer power into the pump through the drive mechanism 4. The form of the drive mechanism 4 can be a gear drive mechanism as described in this embodiment, or can be other power transmission mechanisms. The designs of such a drive mechanism can be easily realized by those skilled in the art, and will not be enumerated.

In this embodiment, an impeller pump is used, and thus, the water pumping device P is located within the bucket body. Of course, a self-priming pump or the like can also be used. In this case, the water pumping device P can be mounted outside the bucket body.

In this embodiment, the bucket 1 has only one container 13. Of course, the bucket 1 can have a plurality of containers 13, the rotating shaft 26 is provided within at least one container 13, and the water pumping device P drains water out of the container 13 which has the rotating shaft 26 disposed therein.

During dewatering, as in the prior art, the rod 2 is pressed so that the dewatering frame 5 and the mop head 3 are rotated for spin-drying. The water within the bucket 1 is pumped out by the water pumping device P. Thus, the height of the bucket body can be reduced, and different from the bucket body in the prior art, it is unnecessary to provide a water storage space below the dewatering basket.

During cleaning, water is injected into the bucket 1. As in the prior art, the rod 2 is pressed, and the mop head 3 and the dewatering frame 5 are rotated so that cleaning can be realized. Meanwhile, during cleaning, the water pumping device P is driven by the drive mechanism 4, and water within the bucket 1 is pumped out by the water pumping device P, so that the dewatering after cleaning can be realized.

The invention claimed is:

1. A cleaning tool set comprising:

a rod;

a mop head attached to the rod;

a wiper attached to the mop head, the rod, the mop head, and the wiper forming a mop; and a bucket for receiving the mop;

wherein, the rod comprises an inner rod, an outer rod sleeved at least partially over the inner rod, and a driving mechanism disposed inside the outer rod and between the inner rod and the outer rod for converting a telescopic motion between the inner rod and an outer rod into a rotating motion of the rod;

the bucket comprises at least one container, a rotatable dewatering frame with a central shaft disposed inside the at least one container, and a water pumping device connected to the dewatering frame or the central shaft, the water pumping device has a water inlet;

the water inlet of the water pumping device is located below the dewatering frame;

when the mop head engages the dewatering frame, the drive mechanism drives the water pumping device and drains water out of the at least one container.

2. The cleaning tool set of claim 1, wherein the water pumping device comprises an impeller pump, a gear pump or a displacement pump.

3. The cleaning tool set of claim 1, wherein the drive mechanism drives the dewatering frame to rotate, and the dewatering frame has a bottom surface and a driving gear disposed on the bottom surface;

the water pumping device is an impeller pump, which includes a pump body, an impeller, a pump shaft disposed in a center of the impeller; the pump body is located within the at least one container with the dewatering frame disposed therein, the pump body has a pump chamber in communication with outside; the impeller is disposed inside the pump chamber; the pump shaft has a top extending out of a top of the pump body, and the pump shaft has a driven gear on the top of the pump shaft, the driven gear is engaged with the driving gear.

4. The cleaning tool set of claim 2, wherein the drive mechanism drives the central shaft to rotate, and a gear sleeve disposed on the central shaft and the gear sleeve has a driving gear;

the water pumping device is an impeller pump, which includes a pump body, an impeller, a pump shaft disposed in a center of the impeller; the pump body is located within the at least one container with the dewatering frame disposed therein, the pump body has a pump chamber communication with outside; the impeller is disposed inside the pump chamber; the pump shaft has a top extending out of a top of the pump body, and the pump shaft has a driven gear on the top of the pump shaft, the driven gear is engaged with the driving gear.

5. The cleaning tool set of claim 2, wherein the central shaft has a cap disposed on a head of the central shaft, the drive mechanism drives the cap to rotate, and a gear sleeve disposed on the central shaft and under the cap and the gear sleeve has a driving gear;

the water pumping device is an impeller pump, which includes a pump body, an impeller, a pump shaft disposed in a center of the impeller; the pump body is located within the at least one container with the dewatering frame disposed therein, the pump body has a pump chamber communication with outside; the impeller is disposed inside the pump chamber; the pump shaft has a top extending out of a top of the pump body, and the pump shaft has a driven gear on the top of pump shaft, the driven gear is engaged with the driving gear.

6. The cleaning tool set of claim 1, wherein the drive mechanism drives the dewatering frame to rotate, the water pumping device is a screw pump, which includes a pumping column and a rotatable screw disposed out of the central shaft and inside the pumping column, the pumping column has a bottom and the bottom of the pumping column is connected with the bucket, the dewatering frame has a bottom surface and the top of the screw is connected with the bottom surface of the dewatering frame, so that the screw can rotate together with the dewatering frame and pump the water inside the pumping column upwards;

the pumping column has a plurality of water pumping holes located below the dewatering frame.

7. The cleaning tool set of claim 1, wherein the drive mechanism drives the central shaft to rotate, the water pumping device is a screw pump, which includes a pumping column and a screw disposed on the central shaft rotatably with the central shaft and inside the pumping column, the pumping column has a bottom and the bottom of the pumping column is connected with the bucket, so that the screw can rotate together with the central shaft and pump the water inside the pumping column upwards;

the pumping column has a plurality of water pumping holes located below the dewatering frame.

8. The cleaning tool set of claim 1, wherein the central shaft has a cap disposed on the head of the central shaft, the drive mechanism drives the cap to rotate;

the water pumping device is a screw pump, which includes a pumping column and a screw disposed out of the central shaft rotatably with the cap and inside the pumping column, the pumping column has a bottom and the bottom of the pumping column is connected with the bucket, so that the screw can rotate together with the cap and pump the water inside the pumping column upwards;

the pumping column has a plurality of water pumping holes located below the dewatering frame.

9. The cleaning tool set of claim 1, further comprising a cleaning bucket having a cleaning basket disposed in the cleaning bucket, a cleaning spindle is provided in the center of the cleaning basket, and the cleaning basket is mounted inside the cleaning bucket through the cleaning spindle.

10. The cleaning tool set of claim 1, further comprising a cleaning and dewatering bucket, which also has the dewatering frame and the water pumping device disposed within;

the water pumping device of the bucket can drain water to the cleaning and dewatering bucket, and the water pumping device in the cleaning and dewatering bucket can drain water to the container with the dewatering frame.

11. A cleaning tool set comprising:

a rod;

a mop head attached to the rod;

a wiper attached to the mop head, the rod, the mop head, and the wiper forming a mop; and a bucket for receiving the mop;

wherein, the rod comprises an inner rod, an outer rod sleeved at least partially over the inner rod, and a driving mechanism disposed inside the outer rod and between the inner rod and the outer rod for converting a telescopic motion between the inner rod and an outer rod into a rotating motion of the rod;

the bucket comprises at least one container, a rotatable dewatering frame with a central shaft disposed inside the at least one container, and a water pump having a water inlet is disposed inside the at least one container having the rotatable dewatering frame, the water inlet of the water pump is located below the dewatering frame, a switch for operating the water pump is disposed inside the at least one container having the dewatering frame; and the water pump drains water in the at least one container having the dewatering frame.

12. The cleaning tool set of claim 11, wherein the switch is a water level switch located below the dewatering frame, and the water level switch is located within the at least one container having the dewatering frame disposed therein.

13. The cleaning tool set of claim 11, wherein the switch is a float switch located below the dewatering frame, and the float switch is located within the container having the dewatering frame disposed therein.

14. The cleaning tool set of claim 11, further comprising a cleaning bucket having a cleaning basket disposed therein, a cleaning spindle is disposed in the center of the cleaning basket, and the cleaning basket is disposed inside the cleaning bucket through the cleaning spindle.

15. The cleaning tool set of claim 11, further comprising a cleaning and dewatering bucket, which also has the dewatering frame, the water pump and the switch disposed therein;

the water pump in the bucket can drain water to the cleaning and dewatering bucket, and the water pump in the cleaning and dewatering bucket can drain water to the at least one container having the dewatering frame.

16. A cleaning tool set comprising:

a rod;

a mop head attached to the rod;

a wiper attached to the mop head, the rod, the mop head, and the wiper forming a mop; and a bucket for receiving the mop;

wherein, the rod comprises an inner rod, an outer rod sleeved at least partially over the inner rod, and a driving mechanism disposed inside the outer rod and between the inner rod and the outer rod for converting a telescopic motion between the inner rod and an outer rod into a rotating motion of the rod;

the bucket comprises at least one container and a water pumping device having a water inlet, a rotating shaft with a rotating plate is disposed inside the at least one container, and the rotating plate has a plurality of retaining ribs for the mop head to resist against;

when the mop head engages the rotating shaft, the mop head rotates the rotating plate, and the water pumping device is driven by the rotating plate to drain water out of at least one container which has the rotating shaft disposed therein; the water inlet of the water pumping device is located below the mop head when the mop head is located on the rotating shaft.

17. A cleaning tool set comprising:

a rod;

a mop head attached to the rod;

a wiper attached to the mop head, the rod, the mop head, and the wiper forming a mop; and a bucket for receiving the mop;

wherein, the rod comprises an inner rod, an outer rod sleeved at least partially over the inner rod, and a driving mechanism disposed inside the outer rod and between the inner rod and the outer rod for converting a telescopic motion between the inner rod and an outer rod into a rotating motion of the rod;

the bucket comprises at least one container and a water pumping device having a water inlet, a rotating shaft with a cap disposed on a head of the rotating shaft is disposed inside the at least one container;

when the mop head engages the cap, the drive mechanism drives the cap to rotate; and the water pumping device is driven by the cap to drain water out of the at least one container with the rotating shaft; the water inlet of the water pumping device is located below the mop head when the mop head engages the cap.

18. A cleaning tool set comprising:

a rod;

a mop head attached to the rod;

a wiper attached to the mop head, the rod, the mop head, and the wiper forming a mop; and a bucket for receiving the mop;

wherein, the rod comprises an inner rod, an outer rod sleeved at least partially over the inner rod, and a driving mechanism disposed inside the outer rod and between the inner rod and the outer rod for converting a telescopic motion between the inner rod and an outer rod into a rotating motion of the rod;

the bucket comprises at least one container and a water pumping device having a water inlet, a rotating shaft is disposed inside the at least one container;

when the mop head engages the rotating shaft, the drive mechanism drives the rotating shaft to rotate; and the water pumping device is driven by the rotating shaft to drain water out of the at least one container with the rotating shaft; the water inlet of the water pumping device is located below the mop head when the mop head engages the rotating shaft.

* * * * *